US006196148B1

(12) United States Patent
Guilhem et al.

(10) Patent No.: US 6,196,148 B1
(45) Date of Patent: Mar. 6, 2001

(54) SEWING METHOD AND SEWING MACHINE FOR RELEASING A TENSION THREAD FROM A PASSAGE FORMED BY A STITCH

(76) Inventors: Christian Guilhem; Marc Guilhem, both of Route Nationale 20 - 82350, Albias (FR)

( * ) Notice: Subject to any disclaimer, the term of this patent is extended or adjusted under 35 U.S.C. 154(b) by 0 days.

(21) Appl. No.: 09/462,596

(22) PCT Filed: Jul. 9, 1998

(86) PCT No.: PCT/FR98/01491

§ 371 Date: Jan. 11, 2000

§ 102(e) Date: Jan. 11, 2000

(87) PCT Pub. No.: WO99/04079

PCT Pub. Date: Jan. 28, 1999

(30) Foreign Application Priority Data

Jul. 15, 1997 (FR) ..... 97 08952

(51) Int. Cl.[7] ..... D05B 29/08
(52) U.S. Cl. ..... 112/475.17; 112/235
(58) Field of Search ..... 112/235, 237, 112/238, 239, 162, 177, 168, 139, 475.17, 475.26, 288

(56) References Cited

U.S. PATENT DOCUMENTS

| | | | | |
|---|---|---|---|---|
| 2,419,494 | * | 4/1947 | Knaus | 112/235 |
| 2,581,603 | * | 1/1952 | Rockerath | 112/235 |
| 3,034,460 | * | 5/1962 | Wennstrom | 112/235 X |
| 3,068,819 | * | 12/1962 | Hedegaard | 112/235 X |
| 3,547,059 | * | 12/1970 | Dolney et al. | 112/235 X |
| 3,752,097 | | 8/1973 | Fuller, Jr. et al. . | |
| 3,933,106 | * | 1/1976 | Murray | 112/235 |
| 4,254,719 | | 3/1981 | Zawick . | |
| 4,732,097 | | 3/1988 | Guilhem . | |
| 5,123,365 | | 6/1992 | Ichimura . | |

FOREIGN PATENT DOCUMENTS

| | | |
|---|---|---|
| 0 223 312 | 5/1987 | (EP) . |
| 2 068 423 | 8/1981 | (GB) . |

* cited by examiner

*Primary Examiner*—Ismael Izaguirre
(74) *Attorney, Agent, or Firm*—Young & Thompson

(57) ABSTRACT

A sewing method having a tension thread, guided and set in a passage of a stitch moved laterally relative to stitching devices between a normal position and a releasing position wherein the tension thread is laterally spaced out of the passage.

27 Claims, 14 Drawing Sheets

54
56
55
17
57
12
13

SEWING METHOD AND SEWING MACHINE FOR RELEASING A TENSION THREAD FROM A PASSAGE FORMED BY A STITCH

BACKGROUND OF THE INVENTION

The invention relates to a sewing method and a sewing machine for sewing on a piece to be sewn such as a flexible cover, a stitch consisting of threads, known as auxiliary threads, of the type which form a passage which extends in the direction of sewing (oversewing, zig-zag, etc), with a thread, known as the tension thread, which is guided and put into position relative to the stitch in the passage, simultaneously with picking up of the auxiliary threads, such that this tension thread can slide longitudinally and/or laterally in this passage, the tension thread not being picked up by the auxiliary threads which form the stitch.

DESCRIPTION OF THE RELATED ART

EP-0 223 312 and U.S. Pat. No. 4,732,097 describe a method and a sewing machine which make it possible in particular to oversew by means of auxiliary threads, and to guide a tension thread, and put it into position into a passage of this oversewing, as this oversewing is being carried out.

This method and this machine are entirely satisfactory. However, it has since been attempted to automate the sewing operations. In fact, this would make it possible to carry out all of the covering method automatically, using a robot.

These sewing operations, which are particularly problematic, still require the presence of a qualified person.

In particular, at the beginning and end of sewing, it is necessary to start and end the oversewing neatly and accurately, and to leave strands of the tension thread which extend beyond the ends of the oversewing, of a sufficient length, and conventionally more than 10 cm, in order subsequently to be able to exert traction on these strands which extend, and then to lock these strands which extend, after traction, by knotting and/or fastening. For this purpose, a large number of manual operations must be carried out before sewing, at the start and end of sewing, and after sewing (release of the strands of tension thread which extend during the oversewing, and cutting off the excess length of oversewing).

In addition, at the beginning and end of sewing, the oversewing must be carried out beyond the piece to be sewn, around the tension thread, for lengths which correspond to the said strands of tension thread which extend, and are to be left free, and these unnecessary excess portions of oversewing are cut off, after the piece has been sewn and has been released from the machine. In addition to the fact that these oversewing operations constitute a waste of thread, time and labour (which can assume substantial proportions within the context of mass production implemented by this method and this machine), sewing of excess portions of oversewing, without a piece to be sewn, corresponds to abnormal functioning of the machine, which gives rise to malfunctioning, interruption of the production pace, and loss of adjustment, or even deterioration of the machine (in particular of the drive lugs which are in direct contact with the foot, in the absence of material). In particular, it should be noted that the assembly of the tension thread and oversewing cannot be guided downstream from the means for picking up, with the same accuracy as when there is a piece to be sewn.

In addition, in some applications, it is also sometimes desirable to be able to release portions of tension thread from the oversewing in certain parts, whilst sewing is taking place, for example in order to form loops to hook the sliding tension thread.

The same problems are posed with other stitches and/or in other applications in which there is laying of a thread, such as a tension thread, simultaneously with sewing of a stitch formed from auxiliary threads other than the tension thread, this tension thread not being an auxiliary sewing thread, and not being picked up, i.e. passed through by the auxiliary threads. For example, the passage for the tension thread can be formed (far less efficiently but satisfactorily in some applications in which the tension thread is not subjected to tension, or is subjected to little tension), by a zig-zag stitch.

Throughout the text, the expression "tension thread" thus covers any thread-type component (including cord, thin cord, large cords, military braid, clothing braid, etc), which may or may not be elastic, other than auxiliary threads used to form the stitch, which is guided and put into position in the passage simultaneously with picking up of the stitch, without being passed through by the auxiliary threads, such that it can slide longitudinally and/or laterally in this passage.

The object of the invention is thus to provide a solution to the above-described problems, and its objective is to provide a sewing method which makes it possible to form, at the start of sewing, and/or whilst sewing is taking place, and/or at the end of sewing, strands of tension thread which are released from the passage formed by the stitch, in particular strands which extend beyond the ends of the passage formed by the stitch, in a simple, quick and reliable manner.

SUMMARY OF THE INVENTION

The object of the invention is in particular to provide a method of this type which can be put into practice in an entirely automated manner, by means of a command from a programmed control device (robot, automaton, computer system, etc), without requiring human intervention.

The object of the invention is thus to permit production, in particular entirely automatically, of strands of a tension thread which extend at the start and end of sewing, at each end of a passage of a stitch, such as an oversewing stitch, in which the tension thread is put into position simultaneously with picking up of the stitch, such as to be able to slide longitudinally and/or laterally in the passage.

The object of the invention is thus to permit production, and in particular entirely automatically, of loops of the tension thread which are released from the said passage whilst sewing is taking place.

The object of the invention is in particular to provide a method of this type which permits full automation of a method for covering an object, such as seat upholstery, by a flexible cover, as described by EP-0 223 312 and/or U.S. Pat. No. 4,732,097. In this respect, the object of the invention is to permit increases in productivity, and saving of labour and raw materials.

The object of the invention is also to make it possible to achieve the aforementioned objectives simply and economically, by means of a simple, cheap modification made to a known sewing machine, and in particular an oversewer as described by EP-0 223 312 and/or U.S. Pat. No. 4,732,097.

The object of the invention is thus to provide a sewing machine which permits implementation of a method according to the invention.

The object of the invention is more particularly to provide a sewing machine of this type which can be obtained by means of a simple modification made to a known sewing machine, and in particular an oversewer as described by EP-0 223 312 and/or U.S. Pat. No. 4,732,097, after production of the machine.

Throughout the text, the terms "upstream" and "downstream" are used with reference to the direction of sewing by the means for picking up of the machine, and to the direction of movement of the piece by these means for picking up, which is thus moved from upstream in the downstream direction. The direction of sewing and movement of the piece is assumed to be horizontal, for reasons of clarity, although this arrangement, which is the most common one in practice, is not strictly essential within the context of the invention. Similarly, "transverse" displacement signifies any displacement relative to the direction of sewing and movement, which has at least one component in a transverse plane perpendicular to the direction of sewing and movement by the means for picking up. "Lateral" displacement signifies any transverse displacement which has at least one horizontal component, i.e. which is parallel to the piece to be sewn, and to the work-holder plate, or in other words, at right angles to the direction of displacement of a needle of the means for picking up. Similarly, "vertical" displacement means any displacement which comprises at least one transverse component, which is at least substantially perpendicular to the piece to be sewn and to the work-holder, i.e. in a plane which is defined by the direction of sewing and by the direction of displacement of a needle.

Transverse displacement can thus be lateral displacement without vertical displacement, vertical displacement without lateral displacement, or a combination of lateral displacement and vertical displacement.

Furthermore, unless otherwise indicated, the terms "picking up" and "picked up" and their derivatives are used in the broadest sense in order to designate the formation of any stitch with threads, without implying that all the threads actually pass through the thickness of the piece sewn. Thus, the expression "means for picking up" designates generally any means which make it possible to produce a stitch (in accordance with AFNOR standard NF G 05-002, the terminology of which is adopted in the present application), by means of one or more threads, and in particular incorporates one or more needles and/or one or more hooks or loopers.

The invention thus relates to a method for sewing, on a piece to be sewn and according to a direction of sewing, a sewing stitch consisting of threads, known as auxiliary threads, by means of picking up means of a sewing machine, this stitch being of the type which forms a passage, which extends in the direction of sewing, with a thread, which is known as the tension thread, which is guided and put into position in this passage simultaneously with picking up of the auxiliary threads, such as to be able to slide longitudinally and/or laterally in this passage, wherein there is displaced transversely relative to the means for picking up, at least one portion of the tension thread, which extends from upstream immediately to downstream from the means for picking up, between a normal position for putting the tension thread into position in the passage, and a position for release of the said portion of the tension thread, in which the portion is inclined relative to the direction of sewing of the stitch, and passes opposite the means for picking up, beyond the area of action of the means for picking up and beyond the said passage, in order, in particular, to permit cutting off independently of the auxiliary threads of the stitch and/or of the tension thread, by at least one cutting blade, which is disposed downstream from the means for picking up, and/or formation of loops of the tension thread, which are released from the said passage, whilst sewing is taking place.

Advantageously and according to the invention, the said portion of the tension thread is displaced during sewing of the stitch, by the means for picking up, i.e. the tension thread is displaced between the normal position and the released position whilst there is continuation of sewing of the auxiliary threads, with formation of stitches, without interruption of the means for picking up. It should be noted in this respect that since the said portion of tension thread extends upstream and at least immediately downstream from the means for picking up, it is possible, by virtue of this fact alone, to avoid virtually all risk of locking of the tension thread by the auxiliary threads, which cannot be picked up such as to pass through the thickness of the tension thread. In fact, the tension thread is released from the passage and from the area of the action of the means for picking up, when it passes opposite, and at right angles relative to the means for picking up. It is also possible to synchronise the means for picking up, and transverse displacement of the said portion of tension thread, in order to prevent this displacement from taking place simultaneously with a descending movement of a picking-up needle.

In addition, sewing machines such as overcasters, oversewers, shearing oversewers, etc, which form a seam at the edge of pieces, comprise a work-holder plate, which extends laterally from a motor frame of the machine. According to a first variant of the invention, which in particular is applicable in order to form strands of the tension thread which extend at the ends of the seam, advantageously and according to the invention, in order to transfer from the normal position to the released position, the said portion of the tension thread is displaced laterally to the side of a work-holder plate, and opposite a motor frame of the sewing machine.

According to a second variant of the invention, which can be combined with the former, and is applicable in particular in order to form loops of the tension thread which are released from the passage formed by the stitch whilst sewing is taking place (i.e. between the two ends of the seam), the said portion of tension thread is displaced vertically, and in particular upwards, by being moved upwards from the piece to be sewn and from the work-holder plate, beyond the area of action of the means for picking up, and in particular above the upper loop hook(s), when at least one upper loop hook of this type is provided.

In addition, advantageously and according to the invention, in order to displace transversely at least the said portion of the tension thread, there is transverse displacement of at least one guiding piece, of the tension thread which is disposed upstream from the means for picking up.

According to one embodiment of the invention, which is applicable in particular in order to form loops of tension thread which are released from the said passage whilst sewing is taking place, there is transverse displacement of a guiding part, which is distinct from a presser unit. This guiding part consists for example of a guiding eyelet, through which the tension thread passes, and which is disposed at the output downstream from the presser unit which is upstream. This embodiment is advantageously applicable to the second above-described variant.

According to another embodiment of the invention, which can be combined with the previous type, advantageously and according to the invention, there is transverse displacement of an upstream presser unit which supports means for guiding the tension thread, and the piece to be sewn is moved by a downstream movement unit, which is disposed immediately downstream from the means for picking up.

The presser unit upstream is in particular a presser foot and/or a rotary unit (wheel, roller, cylinder, etc), which is rotated by a specific motor unit, or is free to rotate around a transverse axis. The downstream moment unit is in particular a downstream presser foot and/or a downstream rotary unit, or a downstream drive lug. This embodiment is advantageously applicable to the first above-described variant, in order to form strands of the tension thread which extend at the ends of the seam. Thus, advantageously and according to the invention, the upstream presser unit is displaced laterally beyond the area of action of the means for picking up, and beyond the said passage. Advantageously and according to the invention, the upstream presser unit is also displaced vertically and upwards, in order, in the release position, to prevent any contact of this presser unit upstream with the piece to be sewn.

It should be noted that, unexpectedly, according to the invention, the sewing is carried out at least partially whilst the upstream presser unit is released, and is thus no longer applied in a functional position on the piece to be sewn. In fact, in practice, it has been found that this is possible without any difficulty, by means of the upstream movement unit, which can move the piece to be sewn and/or the auxiliary threads which form the stitch and/or the tension thread, whilst preventing any malfunctioning, and in particular any phenomenon of jamming.

The above-described variants and embodiments can be combined. Thus, according to the invention, it is possible to displace an upstream presser unit in order to form strands of the tension thread which extend at the ends of the seam, and it is possible to displace laterally and/or vertically a guiding part which is distinct from a presser unit (for example an eyelet) in order to form loops of the tension thread which are released from the said passage whilst sewing is taking place.

Advantageously and according to the invention, the said portion of tension thread is displaced laterally by a distance which is sufficient to release the tension thread and move it away laterally, firstly beyond the area of action of the means for picking up, and secondly beyond the area of action of a first blade for cutting the auxiliary threads, which is disposed downstream, and in particular immediately downstream, from the means for picking up. This first blade is used to cut the auxiliary threads of the stitch without any risk of cutting the tension thread simultaneously.

The invention also relates to a method of this type, which is designed to allow a strand of tension thread, known as the extension thread, to extend, beyond an initial end, and beyond a final end, of the seam formed by the stitching, wherein, on completion of the sewing:

the said portion of the tension thread is displaced laterally by a distance which is sufficient to release the tension thread and move it away laterally from a first blade for cutting of the auxiliary threads, which is disposed downstream from the means for picking up;

sewing of the stitch continues for a length such that the tension thread is released laterally relative to the first cutting blade downstream;

the first cutting blade is actuated in order to cut the auxiliary threads of the stitching, and sewing is interrupted by the means for picking up;

the piece is displaced in the downstream direction, for a length which corresponds to the sum of the lengths of the extending strands of the tension thread, to be formed at the start and at the end of sewing;

the part of the tension thread to be cut is engaged, in order to separate the end extending strand at the end of the piece to be sewn, and the extending strand at the start of a subsequent piece to be sewn, by means of a second cutting blade;

the second cutting blade is actuated; and there is replacement to a normal position of the means for picking up, the means for guiding the tension thread, and the said portion of the tension thread, for receipt and sewing of a subsequent piece to be sewn.

Advantageously and according to the invention, the said portion of the tension thread is replaced in a normal position before the second cutting blade is actuated.

Throughout the present application, "sewing machine" designates any machine which comprises at least one mechanism, known as the sewing head, which incorporates sewing means (means for picking up, work-holder plate, movement units, thread-guide etc). In general, a sewing machine consists of a support structure or frame, at least one sewing head which is mounted on the frame, motor drive means which are supported by the frame (in general at least one electric motor), and control means (pedal(s), knob(s), automatic unit(s) or digital and/or computer system(s), etc) supported by the frame. Throughout the text, the term "sewing machine" can therefore designate either an isolated sewing head, or a more complete assembly, comprising at least one sewing head and other associated units, such as those previously described.

The invention also extends to a sewing machine, in particular a conventional sewing machine which is modified after it has been produced, for implementation of a method according to the invention.

The invention thus relates to a sewing machine comprising means for picking up at least one stitch, formed from auxiliary threads on a piece to be sewn, according to a direction of sewing, this stitch being of the type which forms a passage, which extends in the direction of sewing, and means for guiding a thread, known as the tension thread, for putting auxiliary threads into the position in the passage simultaneously with the picking up, such that this tension thread can slide longitudinally and/or laterally in this passage, wherein it comprises means, known as means for release of the tension thread, in order to displace transversely relatively to the means for picking up, at least one portion of the tension thread, which extends upstream, and immediately downstream from the means for picking up, between a normal position for putting the tension thread into position in the passage, and a position for release of the said portion of the tension thread, in which the latter is inclined relative to the direction of sewing, and passes, opposite means for picking up, beyond the area of action of the means for picking up and beyond the said passage, in order, in particular, to permit cutting off independently of the auxiliary threads of the stitch and/or of the tension thread, by at least a cutting blade which is disposed downstream from the means for picking up, and/or formation of loops of the tension thread, which are released from the said passage whilst sewing is taking place.

Advantageously and according to the invention, the means for release of the tension thread are designed to be able to displace transversely at least the said portion of the tension thread from the means for picking up, whilst sewing is taking place.

The invention also advantageously relates to a machine comprising a motor frame and a work-holder plate which extend altogether on one side of the motor frame, from means for picking up, wherein the means for release of the tension thread are designed to displace the said portion of the tension thread laterally to the side of the work-holder plate, and opposite the motor frame, beyond the said passage, from the normal position to the position of release.

As a variant or in association, advantageously and according to the invention, the means for release are designed to displace the said portion of the tension thread vertically by moving it upwards away from the piece to be sewn, beyond the area of action of the means for picking up.

The invention also advantageously relates to a machine in which the means for picking up comprise at least one needle, and comprise means for movement of the piece to be sewn, wherein the means for movement comprise at least one unit, known as the downstream movement unit, which is disposed immediately downstream from the needle, and the means for release of the tension thread are designed to displace transversely at least one portion of the tension thread, which extends in the upstream direction, from the movement unit downstream.

Advantageously and according to the invention, the means for guiding the tension thread comprise at least one guiding part upstream, which is disposed upstream from the means for picking up, and is supported by means for support, which are designed to be able to position this guiding part in a normal position, in which it guides a tension thread relative to the stitch, or in a position for release of the tension thread, in which it is displaced transversely relative to the means for picking up, such that these means for support of the guiding part(s) upstream act as means for release of the tension thread.

Advantageously and according to the invention, the means for release comprise means which are designed to be able to displace transversely at least one guiding part which is distinct from a presser unit.

Advantageously and according to the invention, the means for release of the tension thread comprise at least one double-action actuation unit, and in particular a pneumatic jack or an electromagnet, which make it possible to displace the tension thread transversely between the normal position and the position for release of the tension thread, and vice versa.

According to a variant, advantageously and according to the invention, the means for guiding the tension thread comprise at least one lateral guiding part for the tension thread, and means to support this guiding part relative to a frame of the machine, and the means for support of this guiding part are designed to be able to place the part in a normal position in which it guides the tension thread relative to the stitch, or in a position for lateral release of the tension thread, in which it is displaced laterally relative to the means for picking up, such that these means for support of the guiding part act as means for release of the tension thread.

According to another variant, which can be combined with the preceding variant, the means for support of an upstream guiding part are designed to be able to position this guiding part in a normal position in which it guides the tension thread relative to the stitch, or in a position for vertical release of the tension thread, in which the guiding part is displaced vertically, and in particular upwards, relative to the means for picking up.

The invention also relates to a machine comprising means for guiding the tension thread, which are formed and/or supported by an upstream movement presser unit for the piece to be sewn, and means for support of the upstream presser unit relative to a frame of the machine, which, in an active position, are designed to apply the upstream presser unit in contact with the part to be sewn, wherein the support means are designed to be able to position the upstream presser unit in a position for release of the tension thread, in which the upstream presser unit and the means for guiding the tension thread are displaced laterally relative to the means for picking up, such that these means for support of the upstream presser unit act as means for release of the tension thread.

Advantageously and according to the invention, the said means for support of the upstream presser unit comprise:

- an arm, which is articulated by a downstream end, on the frame of the machine, such that it can pivot around a vertical axis and around a transverse horizontal axis, and supports the upstream presser unit with the means for guiding the tension thread at its upstream end;
- a double-action actuation unit, which is supported by the frame, and has an actuation rod which is mobile in translation; and
- a rocker bar for connection between the arm and the actuation rod.

The actuation unit is mounted on the frame such that in a normal position, the actuation rod can exert support pressure on the arm in the direction of application of the upstream presser unit, on the piece to be sewn.

Advantageously and according to the invention, the connection rocker bar has torsion such as, from a movement of translation accompanied by rotation specific to the actuation rod, to create movements of lateral displacement of the upstream presser unit, by pivoting of the arm around the vertical axis, and vertical displacement of the upstream presser unit, by pivoting of the arm around the transverse horizontal axis.

Advantageously and according to the invention, the machine comprises a first blade for cutting auxiliary threads, which is disposed downstream from the means for picking up, and the said means for release of the tension thread are designed to displace at least the said portion of the tension thread laterally, by a distance which is sufficient to release the tension thread laterally beyond the first blade for cutting the auxiliary threads.

Advantageously and according to the invention, the machine comprises two blades for cutting threads, the first disposed downstream from the means for picking up, for cutting auxiliary threads of the oversewing, and the second disposed downstream from the first, at a distance corresponding to the length of a strand of tension thread, known as the extension strand, to be left beyond an initial end of the seam formed by the stitch on a subsequent piece to be sewn.

Advantageously and according to the invention, the first blade is disposed immediately downstream and in the vicinity of the downstream movement unit.

The invention makes it possible to render the method according to the invention entirely automatic. For this purpose, advantageously and according to the invention, the machine comprises automatic means for guiding the piece to be sewn relative to the means for guiding, and, if applicable, relative to the cutting blade(s), and means for automatic control of the means for release of the tension thread, and, if applicable, of the cutting blade(s). Advantageously and according to the invention, the means for automatic guiding of the piece to be sewn comprise a grasping robot, which is designed and programmed to displace the piece to be sewn on a work-holder plate of the machine, whilst the sewing is being carried out. Advantageously and according to the invention, the means for automatic guiding of the piece to be sewn and the means for automatic control of the means for release of the tension thread, comprise a programmable digital system, which is designed and programmed to control during sewing the means for picking up, the displacements of the piece to be sewn, the means for release of the tension thread and the cutting blade(s).

The sewing according to the invention can be carried out entirely automatically, and can be included in an automatic method for covering of objects such as seat upholstery.

The invention is more particularly and advantageously applicable to execution of a stitch which consists of oversewing, and in particular oversewing with one, two, three, four or five sewing threads (auxiliary threads). The machine according to the invention is thus advantageously an oversewer, and in particular a shaving, picking-up oversewer.

During sewing, the invention makes it possible automatically to release the tension thread as it slides, outside the passage formed by the stitch, and to replace it there in a normal position, in order to form either loops of tension thread which are released from the passage whilst sewing is taking place, or end strands of a tension thread, beyond the ends of the passage. Loops, which are formed whilst sewing is taking place for example, permit hooking of the tension thread onto hooks or studs of an object to be upholstered, and/or exertion of tension whilst the edge of the piece is being sewn. The end strands make it possible to exert traction on the tension thread, and to lock the tension thread in the taut condition. It should be noted that formation of these loops and/or of these end strands does not prevent the tension thread from sliding in the passage. In fact, the invention makes it possible to prevent the tension thread from being passed through and locked by the auxiliary sewing threads.

The invention also relates to a method and a machine, which comprise in combination some or all of the characteristics previously described, or described hereinafter.

BRIEF DESCRIPTION OF THE DRAWINGS

Other objects, advantages and characteristics of the invention will become apparent from reading the following description, with reference to the attached Figures, in which.

DESCRIPTION OF THE PREFERRED EMBODIMENTS

Figure 1:
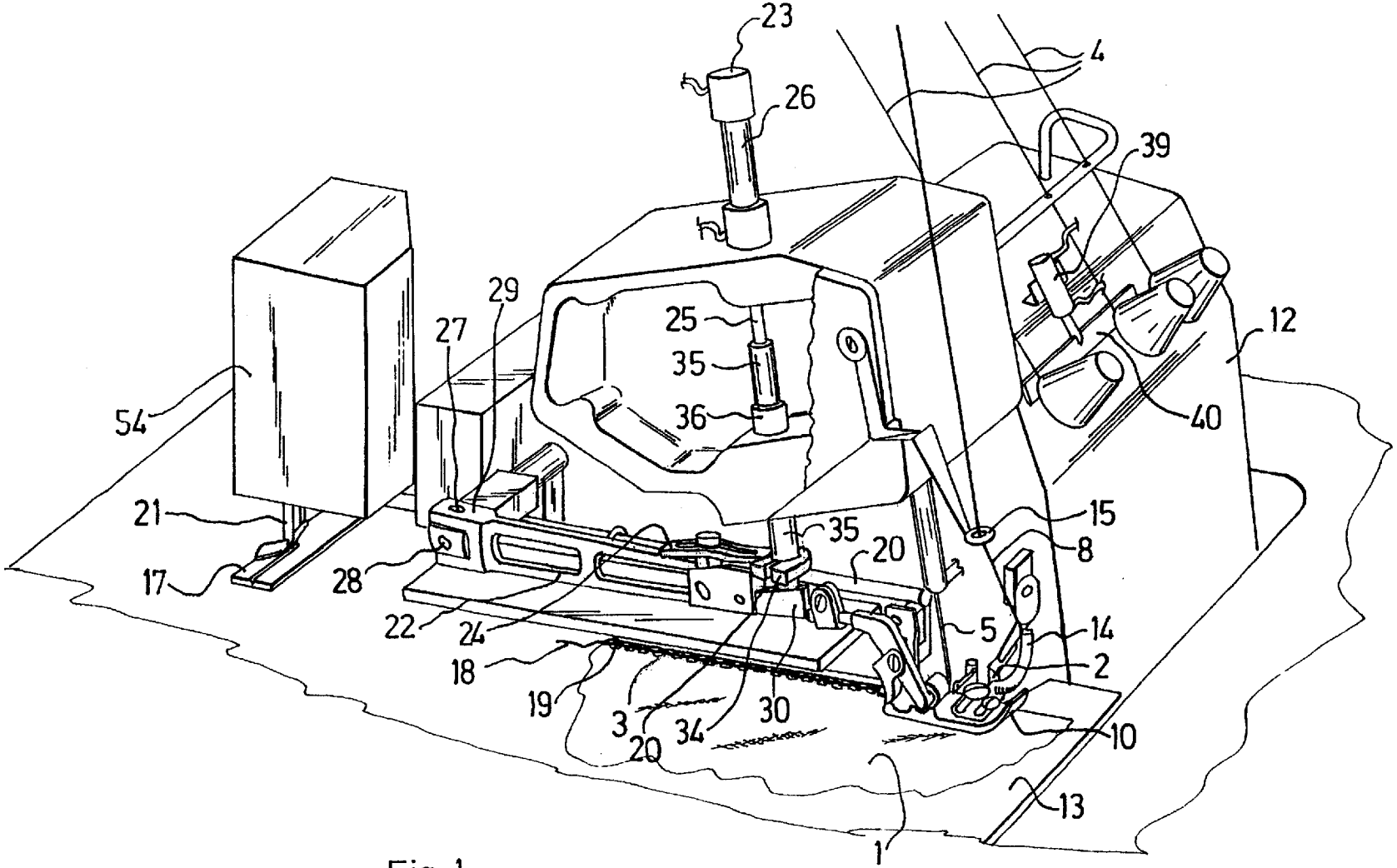
FIG. 1 is a schematic view, partially in perspective, of a machine according to the invention, in the normal position of the tension thread.
Figure 2:
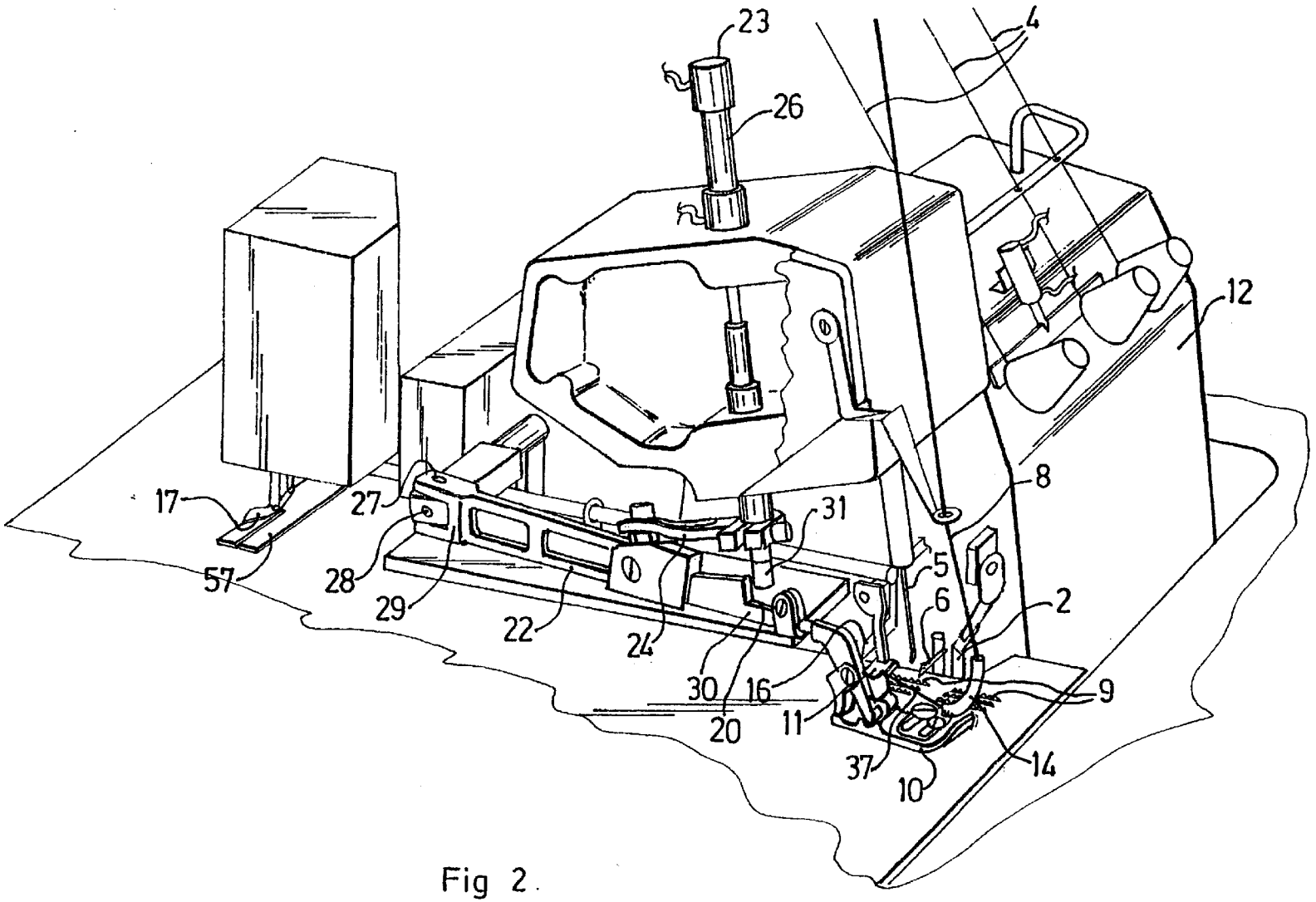
FIG. 2 is a view similar to FIG. 1, illustrating the machine in the released position of the tension thread.

The sewing machine according to the invention shown in the Figures is a shaving oversewing machine, i.e. a machine which is designed to cut the edge of a piece 1 to be sewn (flexible cover made of fabric, leather, synthetic materials or the like) by means of a shaving blade 2, and to execute an oversewing stitch 3 with auxiliary sewing threads 4. As the auxiliary threads 4, transparent nylon threads (330 denier) with a small diameter, or any other industrial sewing thread, can be used.

EP-0 223 312 and U.S. Pat. No. 4,735,097, the content of which is incorporated by reference in the present application, already describe the general characteristics of a sewing machine of this type and of a method for covering of objects such as seat upholstery, which can be implemented by means of a machine of this type. Consequently, only the characteristics which are specific to the invention which is the subject of the present application are described in detail hereinafter.

The sewing machine comprises means 5, 6, 7 for picking up, which, in the example shown, consist of a needle 5, an upper looping hook 6, and a lower hook 7. These means 5–7 for picking up make it possible to produce an oversewing stitch with three threads. However, the invention also extends to any other oversewing stitch, the machine also being equipped with corresponding means for picking up, or more generally, to any stitch which makes it possible to produce a longitudinal passage P, in which a tension thread 8, which is distinct from the auxiliary threads (i.e. which is not one of the threads which forms the said stitch), can be introduced, this tension thread 8 being able to slide longitudinally and/or laterally in the passage P. The tension thread 8 can be formed from a nylon thread, or a cord or small cord, or an elastic thread or the like. In general, its diameter is larger than that of the auxiliary threads, although the contrary is also possible. The sewing machine also comprises means 9–10 for movement of the piece 1 to be sewn, in, and through, the means 5–7 for picking up. The machine substantially comprises a motor frame 12, and a work-holder plate 13, which extend globally on one side of the motor frame 12, from means 5 for picking up. The means 9 to 11 for movement move the piece 1 according to a direction of sewing D which extends along the side of the motor frame 12, from which the work-holder plate 13 extends laterally. The means 9 to 11 for movement comprise a set of motorised lower lugs (i.e. which are driven by a motor of the machine), which pass through the work-holder plate 13 via appropriate aperture, an upstream presser unit 10, which is disposed above the work-holder plate 13, upstream from the means 5 to 7 for picking up, in order to apply the piece 1 to be sewn against the lower lugs 9, and a downstream movement unit 11, which is disposed above the work-holder plate 13, immediately downstream from the means 5–7 for picking up, in order to move the piece 1 to be sewn after picking up has taken place. In the example shown, the upstream presser unit 10 is a conventional presser foot. The downstream movement unit 11 shown is a motorised upper lug which is synchronised with some of the lower lugs 9, and is disposed downstream from the means 5 to 7 for picking up. According to a variant, not shown, the downstream movement unit 11 can also be formed from a simple presser foot, which places the piece 1 on the lower lugs 9.

The shaver blade 2 extends immediately upstream from the means 5 to 7 for picking up, in order to cut or shave the edge of the piece 1, before execution of the oversewing stitch.

The upstream presser unit 10 supports a guiding part 14 for the tension thread 8. In the example shown, this guiding part 14 is in the form of a section of elbowed tube, which extends on the side of the presser foot 10, and is oriented towards the motor frame 12, such that the tension thread is guided immediately upstream from the means 5 to 7 for picking up, parallel to the direction of sewing D, in the axis of the passage P formed by the oversewing stitch. The tension thread 8 is brought as far as the guiding part 14, from a spare bobbin, by at least one guiding unit 15 which is integral with the motor frame 12.

The machine also comprises a first cutting blade 16 (for example a blade reference C-GEX T07, sold by the company C-GEX SYSTEM'S (France)), disposed immediately downstream from the means 9 to 11 for movement and the means 5 to 7 for picking up, i.e. immediately downstream from the downstream movement unit 11. The machine also comprises a second blade 17 (for example an off-centre cutting blade sold by the company C-GEX SYSTEM'S (France), which is disposed along the axis of the first blade 16, according to the direction of sewing D, in the downstream direction, at a distance d1 from the first blade 16, corresponding to the required length for an extending strand 18 of the tension thread 8, to be left free beyond an initial end 19 of the oversewing stitch 3.

Each of the cutting blades 16, 17 is driven by means of a respective actuation drive unit 20, 21, which can be a pneumatic jack, an electromagnet, or any other similar actuation unit. Each cutting blade 16, 17 consists for example of a mobile blade, which can pivot around an axis parallel to the direction of sewing D, and of a fixed blade, which extends at the work-holder plate 13, in the transverse direction, and intersects the direction of sewing D. Thus, the mobile and fixed blades act in the manner of shears, in order to cut the threads which pass over the fixed blade, the mobile blade being moved such as to pivot downwards.

The upstream presser unit 10 with the guiding part 14 is supported by means 22, 23, 24 for support, which comprise an arm 22 which is articulated on the frame 12 of the machine, a double-action actuation unit 23 (i.e. which can be controlled in two opposite directions), the body 26 of which is supported by the frame 12, and which has an actuation rod 25 which is mobile in axial translation in one direction or the other relative to the frame 12, and a rocker arm 24 for connection between the arm 22 and the actuation rod 25. The arm 22 extends globally parallel to the direction of sewing D, above the work-holder plate 13, at least substantially in a horizontal direction. The downstream end 29 of the arm 22 is articulated on the frame 12 of the machine, by means for articulation, in a manner such that the arm 22 can pivot around a vertical axis 27 and around a transverse horizontal axis 28. The actuation unit 23 is for example a double-action pneumatic jack, the body 26 of which is supported by the frame 12 in a direction which is at least substantially vertical, and is slightly inclined downwards and in the upstream direction in the example shown. The upstream end 30 of the arm 22 supports the upstream presser unit 10 with the guiding part 14 for the tension thread 8.

The free end of the actuation rod 25 of the actuation unit 23 is designed such that in a normal position it can exert support pressure on the arm 22, in the direction of application of the upstream presser unit 10, on the part 1 to be sewn, i.e. downwards and towards the work-holder plate 13. In fact, the end of the actuation rod 25 is supported against the arm 22, when the actuation rod 25, which is oriented downwards relative to the body 26, is in the fully extended condition. The end of the actuation rod 25 is advantageously formed from a flattened part 31, which defines a vertical lateral surface, against which the articulated arm 22 abuts laterally. Thus, the actuation rod 25 also limits the possibilities of pivoting of the arm 22, and thus of the upstream presser unit 10, horizontally towards the frame 12. The flattened part 31 also defines a shoulder, which is supported on the upper edge 20 of the arm 22, in order to apply the upstream presser unit vertically downwards, as described hereinafter.

The rocker arm 24 for connection has torsion in its longitudinal direction, such as, from a movement of translation accompanied by rotation of its own (around its axis of translation) of the actuation rod 25, to give rise to movements of lateral displacement of the upstream presser unit 10, by pivoting of the arm 22 around the vertical axis 27, and vertical displacement of the upstream presser unit 10, by pivoting of the arm 22 around the transverse horizontal axis 28. The rocker arm 24 is connected to the arm 22 by a longitudinal aperture 32 provided in this rocker arm 24, in which a slide 33, which is integral with the arm 22, can slide. The slide 33 simply consists for example of a headed screw, which passes through the aperture 32, and is engaged in a corresponding female thread in the arm 22. The rocker arm 24 for connection is also rendered integral with the actuation rod 25, by means of a collar 34 which is clamped by a screw.

By means of a mechanism of this type, when the actuation rod 25 rises in the body 26 of the jack, the torsion of the rocker arm 24 for connection gives rise to movement of pivoting of the arm 22 around the vertical axis 27, laterally opposite the frame 12, and around the transverse horizontal axis 28, vertically upwards.

It should be noted that during this movement, the actuation rod 25 rotates around itself, around its longitudinal axis. This movement of rotation of its own, and pivoting of the arm 22 around the vertical axis 27, can be obtained from the torsion of the rocker arm 24 for connection, and/or can be obtained by means of specific means 35, 36 for guiding in rotation, of the actuation rod 25, during its displacement in translation. In the example shown, a sleeve 35 is rendered integral with the actuation rod 25, by any appropriate means (cotter pins, radial pins, etc), and this sleeve 35 supports at least one radial dog point 51 which projects towards the exterior, and cooperates with inclined support surfaces 52, which have appropriate shapes, provided in a bush 36, which itself is supported by the frame 12, with which it is integral. The actuation rod 25 and its sleeve 35 pass axially through the bush 36. The dog point 51 of the sleeve 35 and the support surfaces 52 of the bush 36 are designed to give rise to rotation of the rod 25 around its own axis, in one direction or the other, when the rod is displaced in translation in one direction or the other.

Thus, the means 22, 23, 24 for support of the upstream presser unit 10 act, together with the guiding part 14, as means for release of the tension thread 8, and are designed to displace transversely, laterally, opposite the motor frame 12, and vertically, a portion 37 of the tension thread 8 which extends between the downstream movement unit 11 and the guiding part 14. This portion 37 of the tension thread is that which extends firstly immediately downstream from the means 5, 6, 7 for picking up, as far as the downstream movement unit 11, and immediately upstream from the means 5, 6, 7 for picking up, as far as the guiding part 14. In other words, this portion 37 of the tension thread is that which extends immediately from downstream and in the upstream direction, from means 5, 6, 7 for picking up. This portion 37 of the tension thread is that which passes into the area of action of the means 5, 6, 7 for picking up, and which is being sewn. The means 14, 22, 23, 24 for release are designed such that the guiding part 14 can be placed either in the normal position, in which it guides the tension thread 8 in the direction of sewing D in the passage P, as previously described, or in the position for release, in which the portion 37 of the tension thread 8 is displaced laterally and vertically upwards relative to the means 5, 6, 7 for picking up, and is inclined relative to the direction of sewing D, in order to pass, opposite the means 5, 6, 7 for picking up, beyond the area of action of the means 5, 6, 7 for picking up, and beyond the passage P formed by the oversewing stitch.

In the variant shown in FIGS. 1 to 11, all of the part of the tension thread 8 which extends upstream from the downstream movement unit 11, and as far as the guiding part(s) 15 which is/are integral with the frame 12, is displaced laterally by the means 22, 23, 24 for release. However, it should be noted that other variant embodiments are possible, since at least one portion 37 of the tension thread which extends in the upstream direction from the downstream movement unit 11, immediately downstream and upstream from the means 5, 6, 7 for picking up, can be displaced laterally in order to release the tension thread 8 from the area of action of the means 5, 6, 7 for picking up, and beyond the passage P and the first blade 16.

The method implemented by means of a machine of this type is represented in FIGS. 3 to 11.

Figure 3:
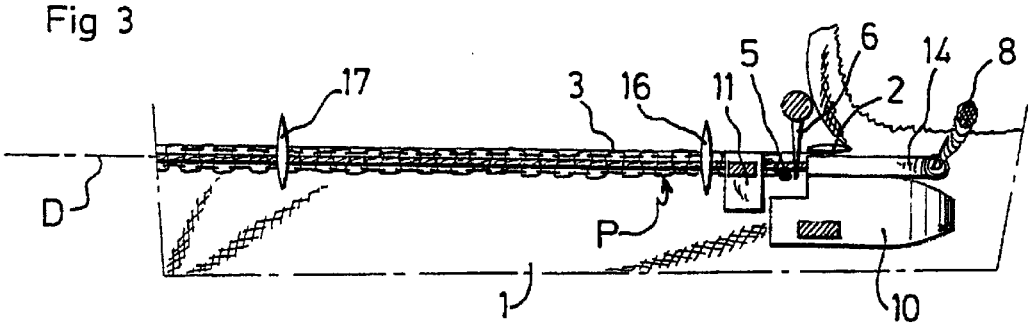
FIGS. 3 to 9 are partial schematic plan views, illustrating different steps of a method according to the invention in chronological order.
Figure 4:
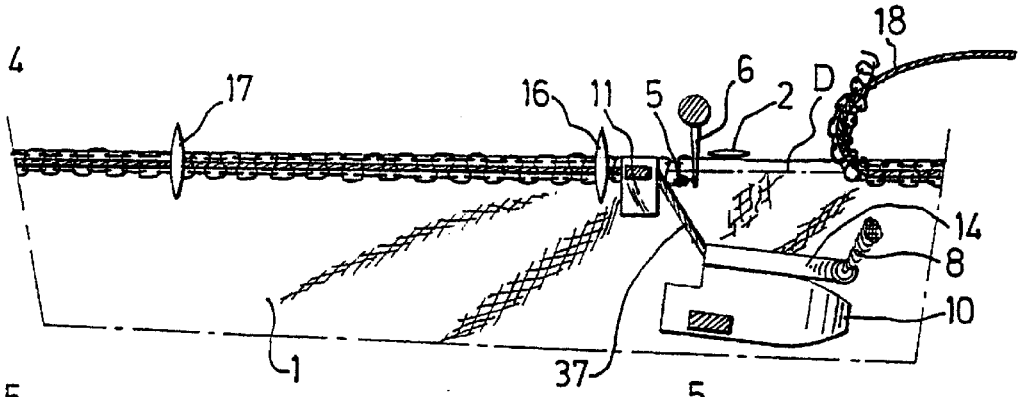
Figure 10:
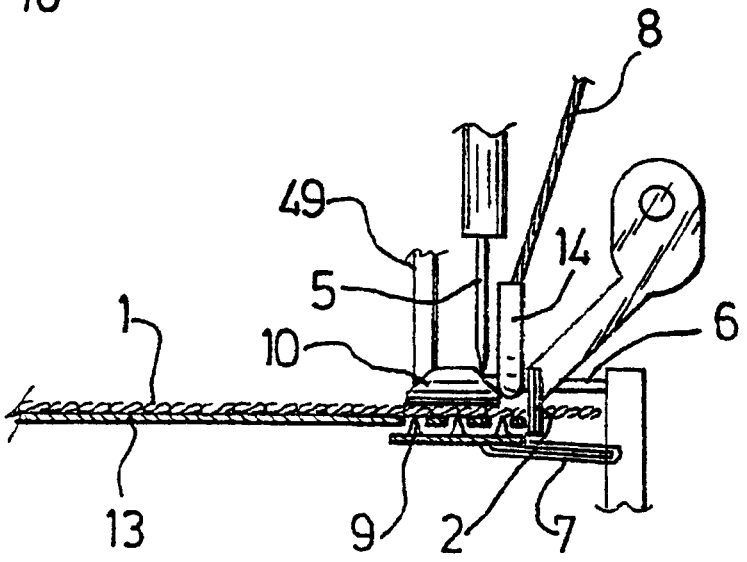
FIGS. 10 and 11 are partial schematic views from the front, illustrating respectively the means for release of the tension thread in a normal position and in a released position, of a machine according to the invention.
Figure 11:
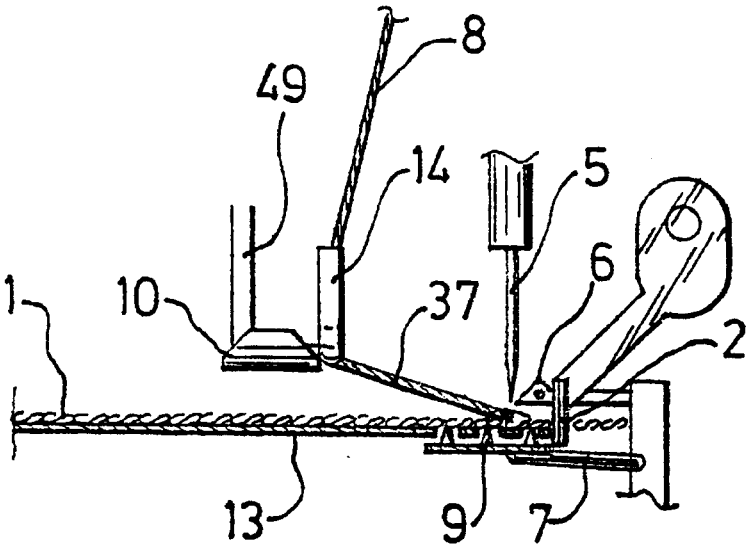
Figure 12:
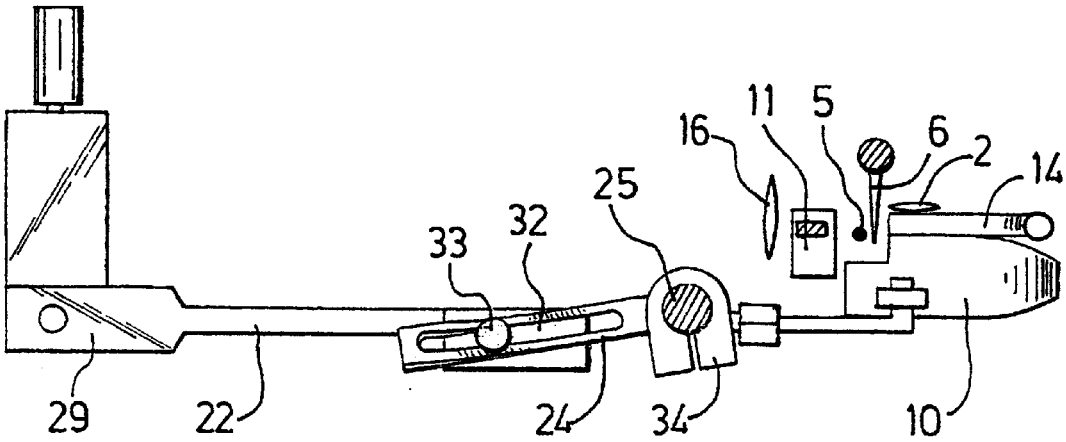
FIGS. 12 and 13 are partial schematic plan views, illustrating respectively means for release of the tension thread in a normal position and in a released position, of a machine according to the invention.
Figure 13:
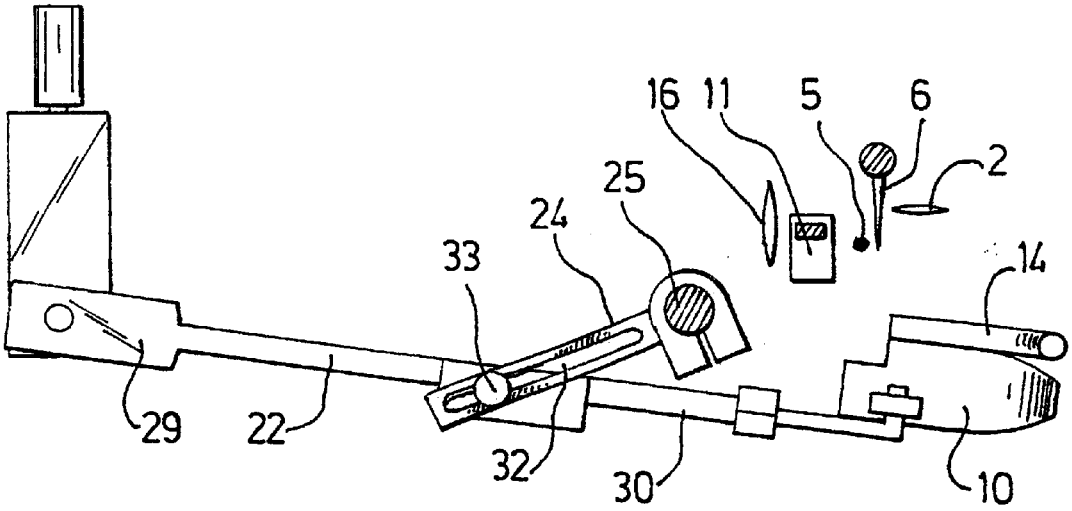
Figure 14:
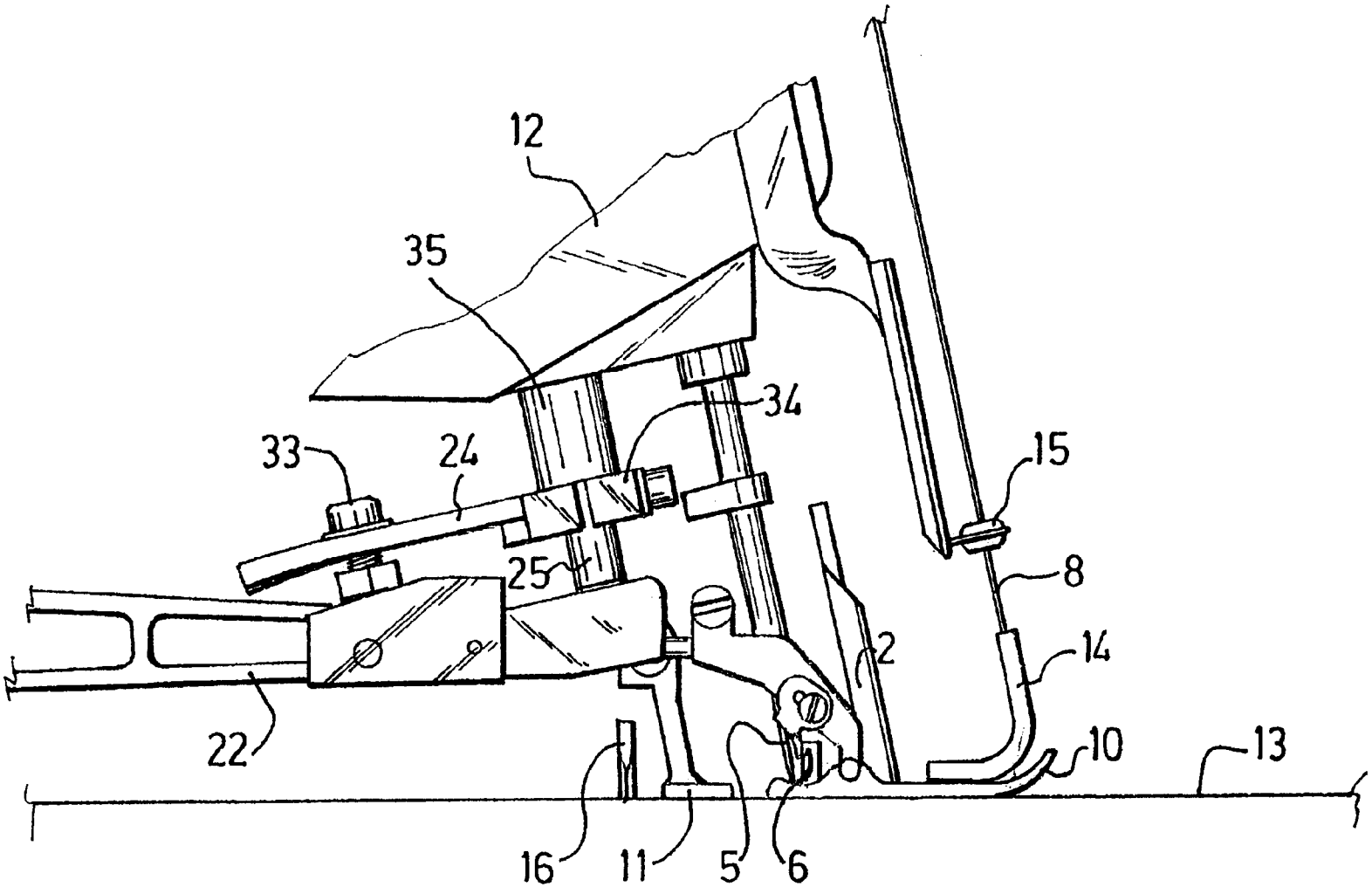
FIG. 14 is a partial schematic lateral view illustrating the means for picking up and means for release of a machine according to the invention.
Figure 15A:
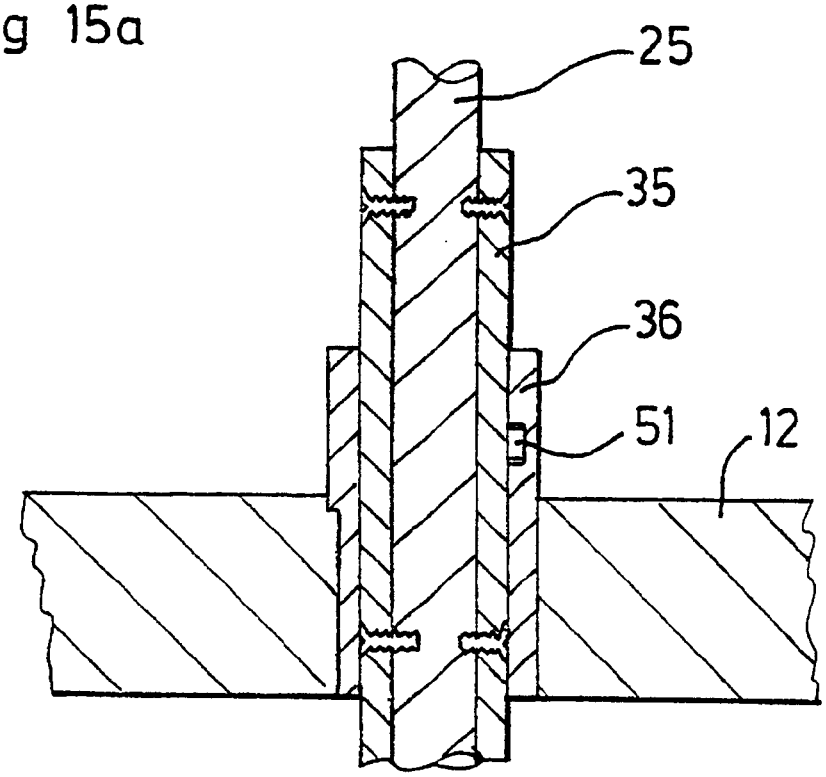
FIG. 15*a* is a schematic view in axial cross-section of the means for guiding in rotation specific to the actuation rod of the means for release of the tension thread of a machine according to the invention.
Figure 15B:
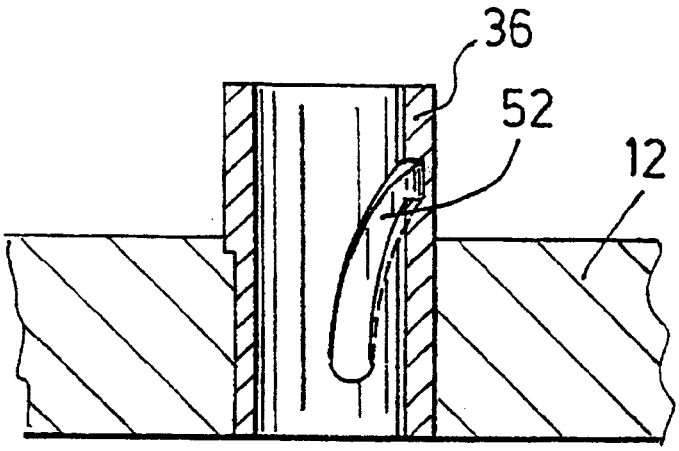
FIG. 15*b* is a view similar to 15*a*, shown without the actuation rod.

FIGS. 1, 3 and 10 show the upstream presser unit 10 and the guiding part 14 in the normal position, the tension thread 8 normally being engaged in the passage P defined by the oversewing stitch 3 along the edge of the piece 1 to be sewn. From this normal position, and during the sewing itself, i.e. without interruption of the means 5 to 7 for picking up, by actuating the jack 23, it is possible to place the upstream presser unit 10 and the guiding part 14 in the position of release (FIGS. 2, 4, 5 and 11). The portion 37 of the tension thread 8 which extends between the downstream movement unit 11 and the guiding part 14 has inclination laterally and upwards relative to the direction of sewing D. It should be noted that this arrangement prevents in particular picking up of the tension thread 8 by the needle 5, since the entire portion 37 of the tension thread 8 which extends in the upstream direction from the downstream movement unit 11, is displaced laterally and is inclined relative to the direction of sewing D. The tension thread 8 is thus not passed through by one of the auxiliary threads 4 of the sewing.

Figure 5:
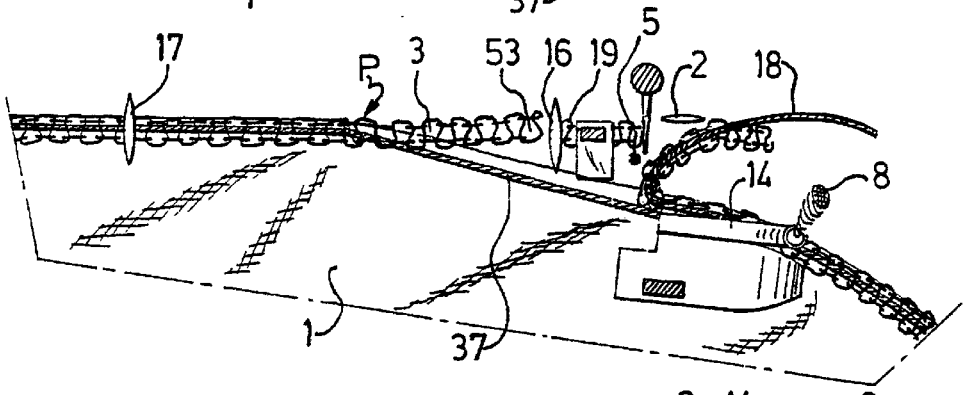

FIG. 5 shows the arrangement obtained after formation of some additional oversewing stitches, the intersection between the portion 37 of the tension thread 8 and sewing of the oversewing stitch 3 being displaced in the downstream direction, the portion 37 of the tension thread being released laterally from the downstream movement unit 11 and from the first cutting blade 16. As can be seen, in this position, the portion 37 of the tension thread 8 is released beyond this first blade 16, which, when it is actuated as shown in FIG. 5, cuts only the oversewing stitch 3, i.e. the auxiliary threads 4, in order to form a final end 53 of the oversewing stitch 3 for the piece 1 to be sewn, at the end of the seam, and an initial end 19 of the oversewing stitch 3 for a subsequent piece 1 to be sewn.

In addition, it should be noted that by executing these final oversewing stitches before cutting the auxiliary threads 4 of the oversewing stitch, it is possible to release the piece 1 to be sewn when the sewing is completed, beyond the means 5, 6, 7 for picking up, since the upstream presser unit 10 is no longer applied to the piece 1 to be sewn. In the arrangement in FIG. 5, the piece 1 to be sewn is thus released laterally from the means 5, 6, 7 for picking up and the downstream movement unit 11. It should be noted that in this arrangement, there is avoidance of any wear by friction between the upstream presser unit 10 and the lugs 9, despite the absence of fabric.

It should also be noted that after the tension thread 8 has been released beyond the oversewing stitching 3, this oversewing stitching 3 can again be sewn onto the piece 1 for a specific length. FIG. 5 shows some oversewing stitches picked up on the piece 1, extended by some oversewing stitches picked up beyond the piece 1. According to a variant, not shown, it is possible to maintain the upstream presser unit 10 in the released position whilst the oversewing seam is being sewn (rather than at the ends), then to continue sewing the oversewing stitch 3 on the piece 1, then replace the upstream presser unit 10 in the normal sewing position, in order to continue sewing the oversewing stitch 3. This therefore forms a strand of tension thread 8 which is released beyond the oversewing stitch 3 whilst sewing is taking place, i.e. a loop of tension thread 8, which can be used for example for hooking and tension of the piece 1 onto a support.

Figure 6:
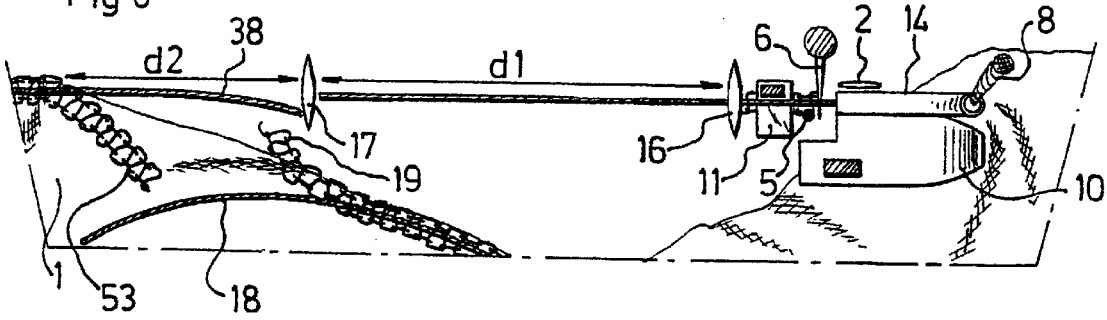

FIG. 6 shows a further position in which the upstream portion 37 of the tension thread 8, which is released from the passage P of the oversewing stitch 3, is brought opposite and against the second cutting blade 17, and is then cut by this second blade 17. In order to facilitate alignment of the tension thread 8 with this second blade 17, the upstream presser unit 10 and the guiding part 14 have previously been brought into the normal position (by controlling the jack 23 in the direction of descent of the actuation rod 25). Preferably, as soon as the auxiliary threads 4 of the oversewing stitch 3 have been cut by the first blade 16 (FIG. 5), the means 5, 6, 7 for picking up, and the means 9, 10, 11 for movement are interrupted.

As can be seen in FIG. 6, the piece 1 is then provided with an extending strand 38 of the tension thread 8, which is then left free beyond the oversewing stitch 3 at the end of the seam. The length d2 of this extending strand 38 depends on the length of the portion of tension thread 8 which has been passed downstream starting from, and beyond, the second cutting blade 17.

The part 1 also comprises an extending strand 18 which has previously been formed at the beginning of the seam, the length d1 of which depends on the distance between the second blade 17 and the first blade 16.

Advantageously, the second blade 17 is secured to the machine such as to permit adjustments of the position of the second blade 17, and thus of this length d1.

Figure 16:
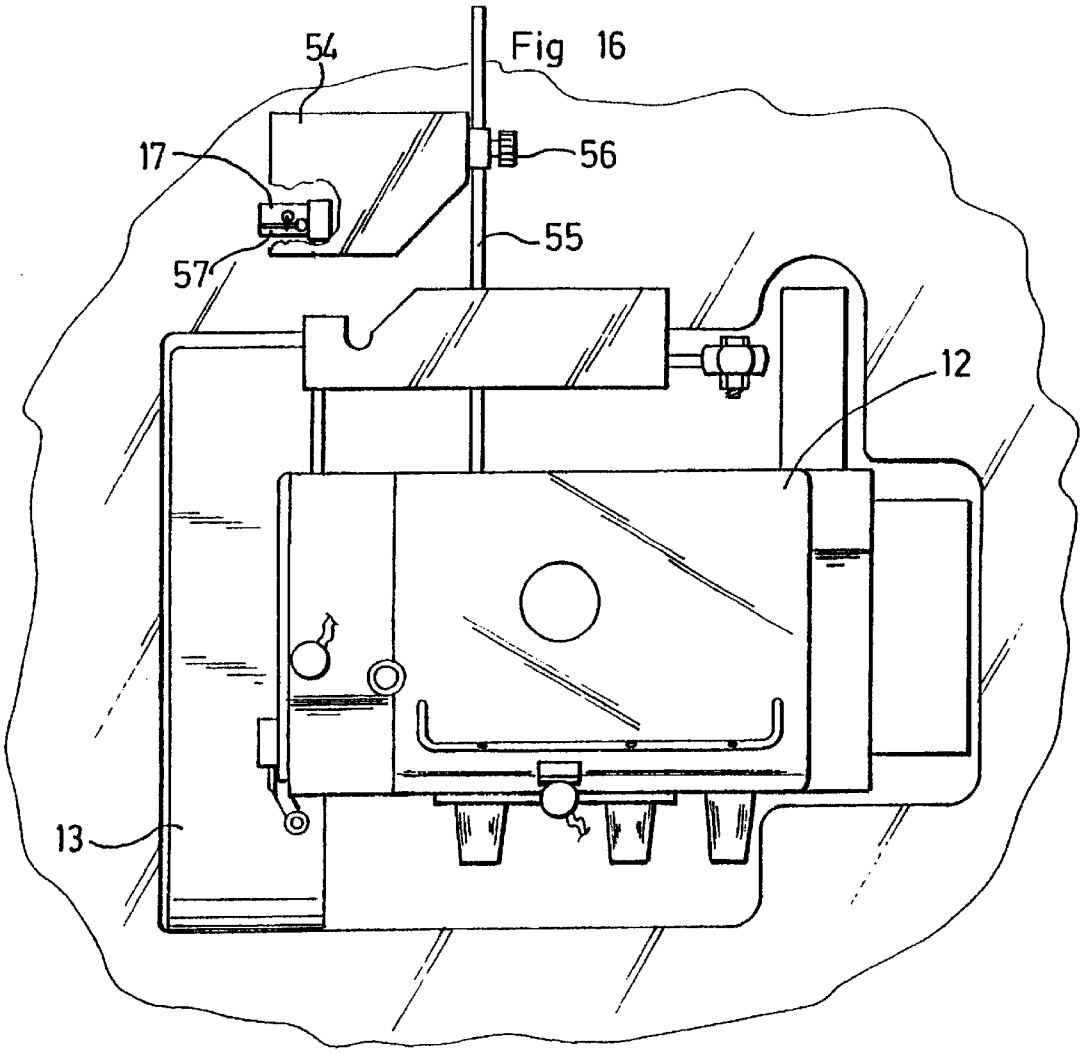
FIG. 16 is a partial schematic plan view of a machine according to the invention.

For this purpose, the second blade 17 is supported entirely (mobile blade and fixed blade) by a frame 54 (FIG. 16), which is mounted in a sliding manner on a slide 55, which extends parallel to the direction of sewing D, in the downstream direction, from the motor frame 12 of the machine to which it is secured. A knurled clamping knob 56 makes it possible to lock the frame 54 in place on the slide 55, after adjustment has taken place. The fixed part of the blade 17 is formed by a plate 57 which is supported on the work-holder plate 13. The frame 54 also advantageously supports a drive unit 21 for actuation of the blade 17. When the frame 54 is displaced along the slide 55, the distance d1 is modified, whilst keeping the second blade 17 aligned with the first blade 16, in the direction of sewing D.

Figure 7:
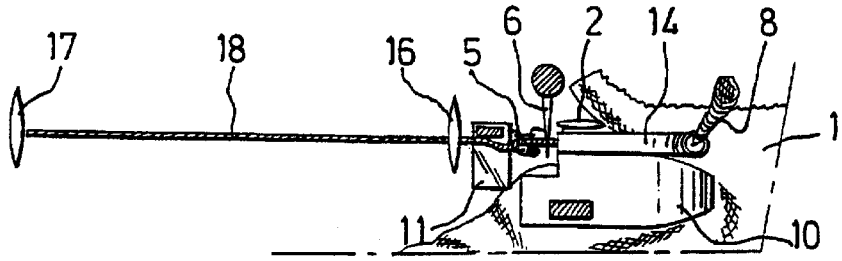

From the position shown in FIG. 6, it is possible to begin sewing a new piece 1, which is engaged beneath the presser foot 10, as shown in FIG. 7.

Advantageously, in order to ensure that the tension thread 8 passes laterally beyond the vertical needle 5 towards the motor frame 12, when the guiding part 14 is brought into the normal position, there is simultaneous decrease of the tension of the auxiliary threads 4 of the oversewing stitch 3, and in particular at least of the tension of the auxiliary thread 4 of the needle, and of the auxiliary thread 4 of the upper hook. For this purpose, the machine according to the invention is provided with a double-effect actuation unit, such as a pneumatic jack 39, the actuation rod of which supports at least one thickness wedge 40, which is designed to be able to engage between the pressure washers which regulate the tension of the threads 4 of the needle and upper hook (FIG. 1). In the normal position, the thickness wedge 40 is released from these pressure washers, such that the tension of the threads is that which is obtained conventionally by means of the adjustments carried out on the machine. When the jack 23 for actuation of the release means is actuated in the direction of return of the guiding part 14 in the normal position, the jack 39 which supports the wedge 40 is simultaneously actuated in order to engage the thickness wedge 40 in the pressure washers for the needle thread and for the upper hook thread, and to release the auxiliary threads 4 completely. By this means, the tension thread 8 extends beyond the needle 5 towards the motor frame 12, or abuts this needle 5, and passes beyond it the next time the needle is raised. This therefore prevents with certainty the passage of the needle 5 through the tension thread 8, and thus locking of this tension thread 8 on the piece 1, which would hinder the possibilities of further sliding of this thread in the passage P of the oversewing stitch 3.

Figure 8:
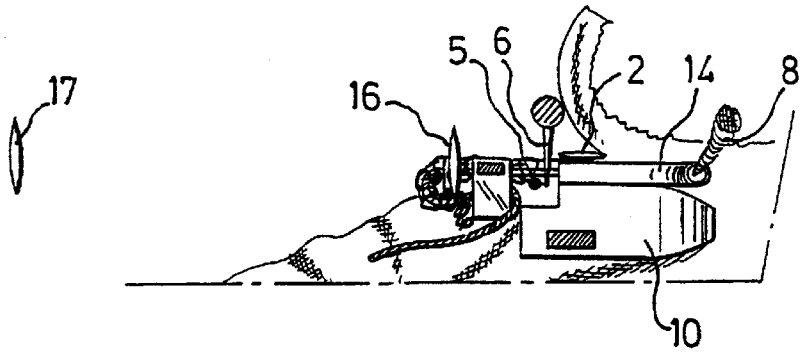
Figure 9:
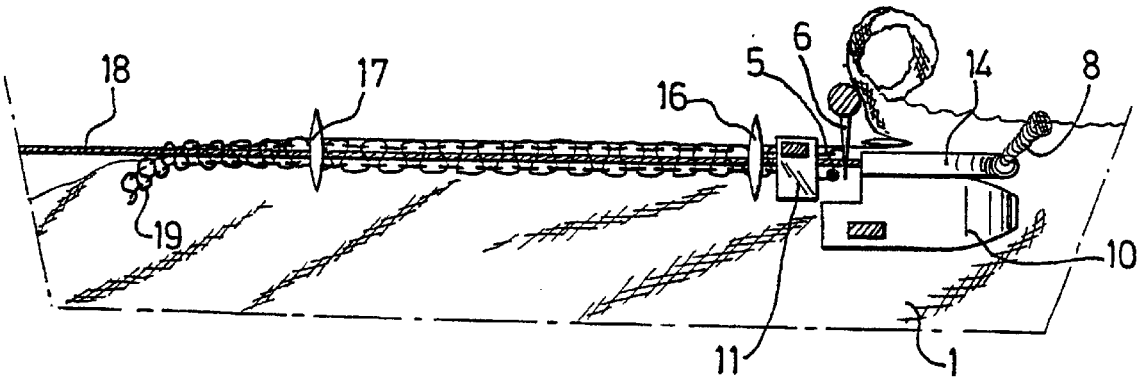

When sewing of a new piece 1 is begun as shown in FIG. 7, the tension thread 8 is not always engaged beneath the downstream movement unit 11, but, as shown in the Figures, can be positioned above this downstream movement unit 11, which is generally in the form of a plate. When sewing of the oversewing stitch 3 is begun, as shown in FIG. 8, the extending strand 18 is drawn beneath the downstream movement unit 11, and thus naturally passes around the latter as shown in FIG. 9. By this means, in all cases, the position shown in FIG. 9 is obtained, in which the seam can be continued and completed as previously described.

Figure 17:
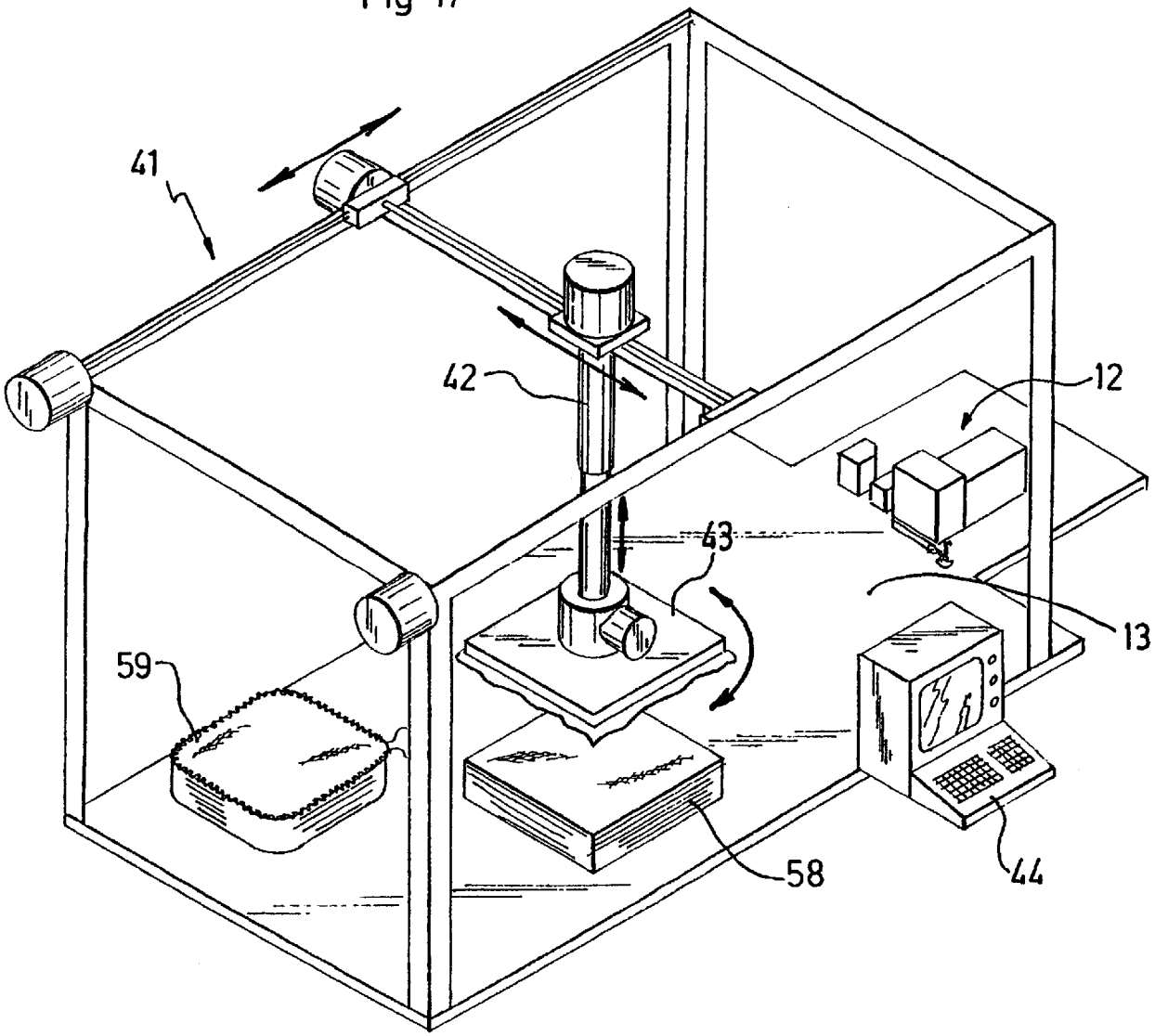
FIG. 17 is a general perspective schematic view of an automatic machine according to the invention.

After the oversewing stitch 3 has been cut by the first blade 16, and until the tension thread 8 is cut by the second blade 17, the piece 1 is displaced in the downstream direction, such that a length corresponding to the sum d1+d2 of the length of the extending strands 18, 38 of the tension thread at the start and end of the seam are obtained, and extend in the downstream direction from the first blade 16. These movements of the piece 1 on the work-holder plate 13, and relative to the machine, can be obtained by automatic means 41 to 44 for guiding the piece 1 to be sewn (FIG. 17). These means 41 to 44 consist for example of a frame 41 which extends in particular above the work-holder plate 13, and supports a vertical column 42, at the lower end of which there is secured a plate 43, which is provided with means for grasping the piece 1, the movements of the assembly being controlled by a programmable numerical system 44 (automaton, computer system, etc). The frame 41 is designed to permit displacements in translation of the column 42 and of the plate 43 in both horizontal directions. The column 42 and the plate 43 are designed such that the latter can firstly be controlled, relative to the work-holder plate 13, such that it is rotated around a vertical axis, and secondly, can be controlled in translations upwards or downwards in a vertical direction. The assembly thus constitutes a grasping robot, which is designed and programmed to displace the piece 1 on the work-holder plate 13 of the machine, as sewing takes place. This robot is also designed to take a piece 1 from a pile 58 of pieces to be sewn which are waiting, and to engage the piece beneath the upstream presser unit 10 of the machine at the beginning of sewing. This robot is also programmed to displace the piece 1 at the end of sewing of the distance d1+d2, with the tension thread 8 at the second blade 17 as previously described, then to place each piece sewn on a pile 59 of pieces sewn. The programmable numerical system 44 is also programmed to control the various actuation units 23, 39, and the general functioning of the machine, in particular the means 9 to 11 for movement, and the means 5 to 7 for picking up.

The plate 43 is provided with means for grasping pieces 1, making it possible to take one piece 1 alone from the stack 58 of pieces to be sewn, then to release the piece 1 onto the stack 59 after sewing has taken place. These grasping means can be produced in any appropriate manner, according to the nature of the pieces 1, by means of a sucker (suction of air), by claws for grasping fabric (such as the claws with reference SCH 20 or ST 36 sold by the company SOMMER AUTOMATIC (Germany)), by a repositionable self-adhesive, by hooking means of the loop and claw type (VELCRO, registered trade mark), by static electricity and by gripping, etc.

The production and programming of a grasping robot and its associated programmable numerical system as previously described are known, and do not constitute any particular difficulties. In particular, the assembly can be produced by means of step-by-step electric motors, each of which generates movements, encoders, and conventional numerical control programming.

The invention can form the basis of several variants in comparison with the embodiment previously described. In particular, if it is advantageous to release the upstream presser foot 10 laterally, simultaneously with the guiding part 14, subsequent entrainment of the oversewing stitch 3 (without any tension thread or piece 1) being obtained satisfactorily by means of the downstream movement unit 11, it is also possible to release the tension thread 8 without displacing the upstream presser unit 10.

Figure 18:
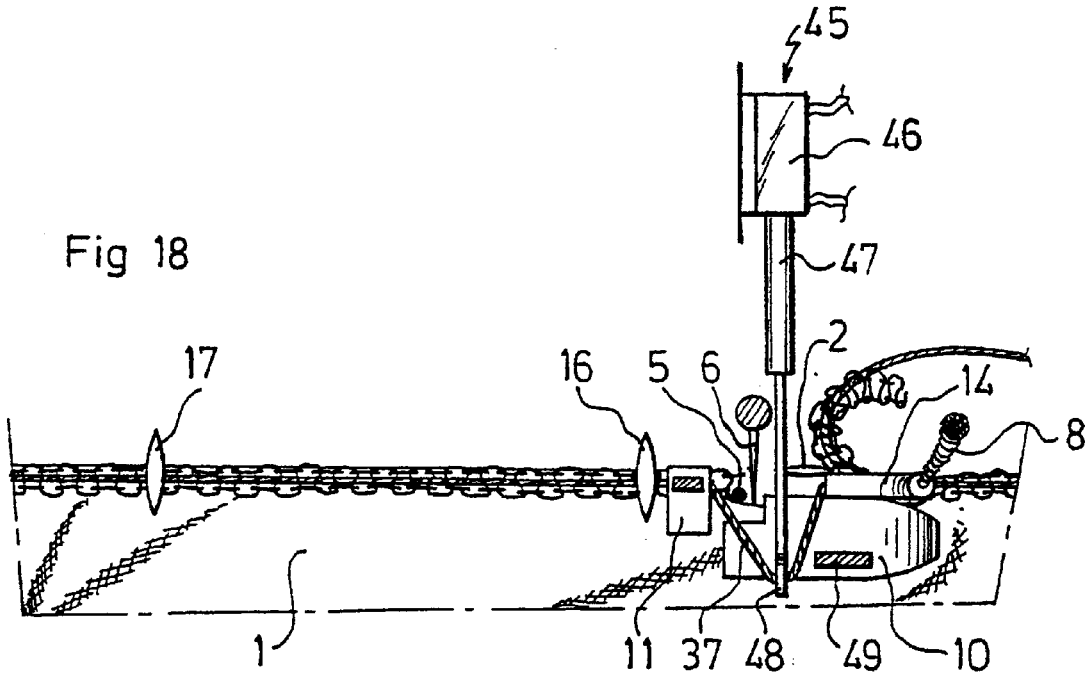
FIGS. 18 to 20 are partial schematic plan views, illustrating respectively two variant embodiments of the means for release of the tension thread of a machine according to the invention.

Thus, according to a first embodiment (FIG. 18), the release means consist of a horizontal jack 45, the body 46 of which is supported by the frame 12, and the actuation rod 47 of which is connected to a guiding eyelet 48, through which the tension thread 8 passes. In the normal position, this eyelet 48 is disposed at the downstream output of the guiding part (tube) 14 which is supported by the upstream presser unit 10. The eyelet 48 is nevertheless disposed upstream from the means 5, 6, 7 for picking up. The guiding eyelet 48 is thus itself a lateral guiding part for the tension thread 8, which is disposed downstream from the upstream presser unit 10 and the guiding part 14 which it supports, and upstream from the means 5, 6, 7 for picking up, such that this guiding eyelet 48 displaces laterally the portion of the tension thread 8 which extends between the downstream movement unit 11 and the output of the guiding part 14 which is supported by the upstream presser unit 10. The jack 45 is designed to be able to place the eyelet 48 either in a normal position opposite the output of the guiding part 14, or in a position released laterally, in which the eyelet 48 is displaced laterally opposite the frame 12, and beyond the upstream presser unit 10, in order to displace laterally the portion 37 of tension thread 8 (FIG. 18). The upstream presser unit 10 must have a shape which is appropriate to permit the movements in transverse translation of the rod 47 for actuation of the jack 45 and of the eyelet 48. In particular, the upstream presser unit 10 is supported by a support arm 49, which must be disposed sufficiently far upstream for the eyelet 48 to be displaced downstream from this support arm 49, the tension thread 8 not passing upstream from this support arm 49.

Figure 19:
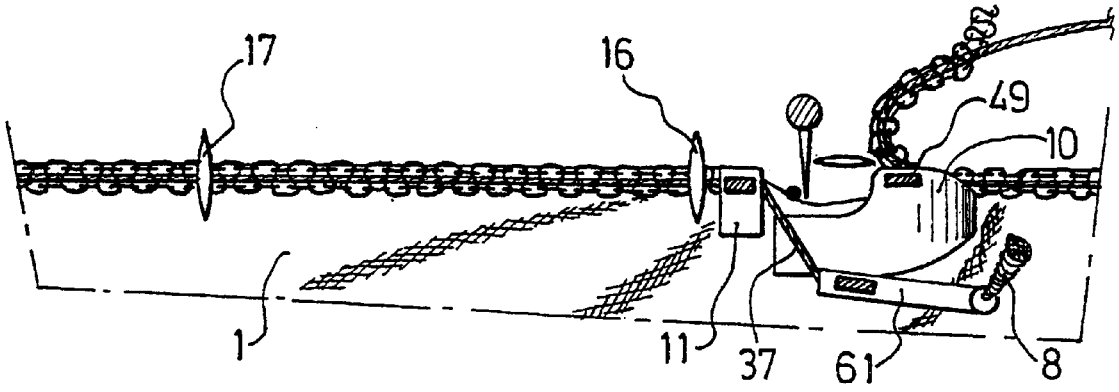

According to another variant of the invention (FIG. 19), the upstream presser unit 10 is supported by an arm 49 which is fixed relative to the frame 12, and the articulated arm 22 supports a guiding part 61 in the form of a tube, similar to the guiding part 14 in the first variant, but which is disconnected from the upstream presser unit 10. The arm 22 is controlled in its movements by the jack 23 and the rocker arm 24 for connection, as described for the first variant. The support arm 49 for the upstream presser unit 10 must then extend between the guiding part 61 and the motor frame 12, such that the guiding part 61 for the tension thread 8 can be displaced laterally, freely relative to the upstream presser unit, opposite the frame 12, as shown in FIG. 19. The shape of the upstream presser unit 10 is slightly modified in order to extend further upstream from the shaver blade 2, and laterally relative to the side of the frame 12, than in the embodiments previously described.

The variants in FIGS. 18 and 19 make it possible to release the tension thread 8 transversely, whilst maintaining guiding of the piece 1 to be sewn, by means of the upstream presser unit 10. Thus, in particular, it is possible to form loops of the tension thread whilst sewing is taking place, and whilst providing accurate guiding of the piece 1 to be sewn, by the upstream presser unit 10. Picking up of the tension thread 8 by the needle 5 during lateral displacement of the guiding part 14, 48, 61 is most improbable, and can be prevented by appropriate synchronisation of the actuation unit 23, 45 with the movements of the needle 5.

Figure 20:
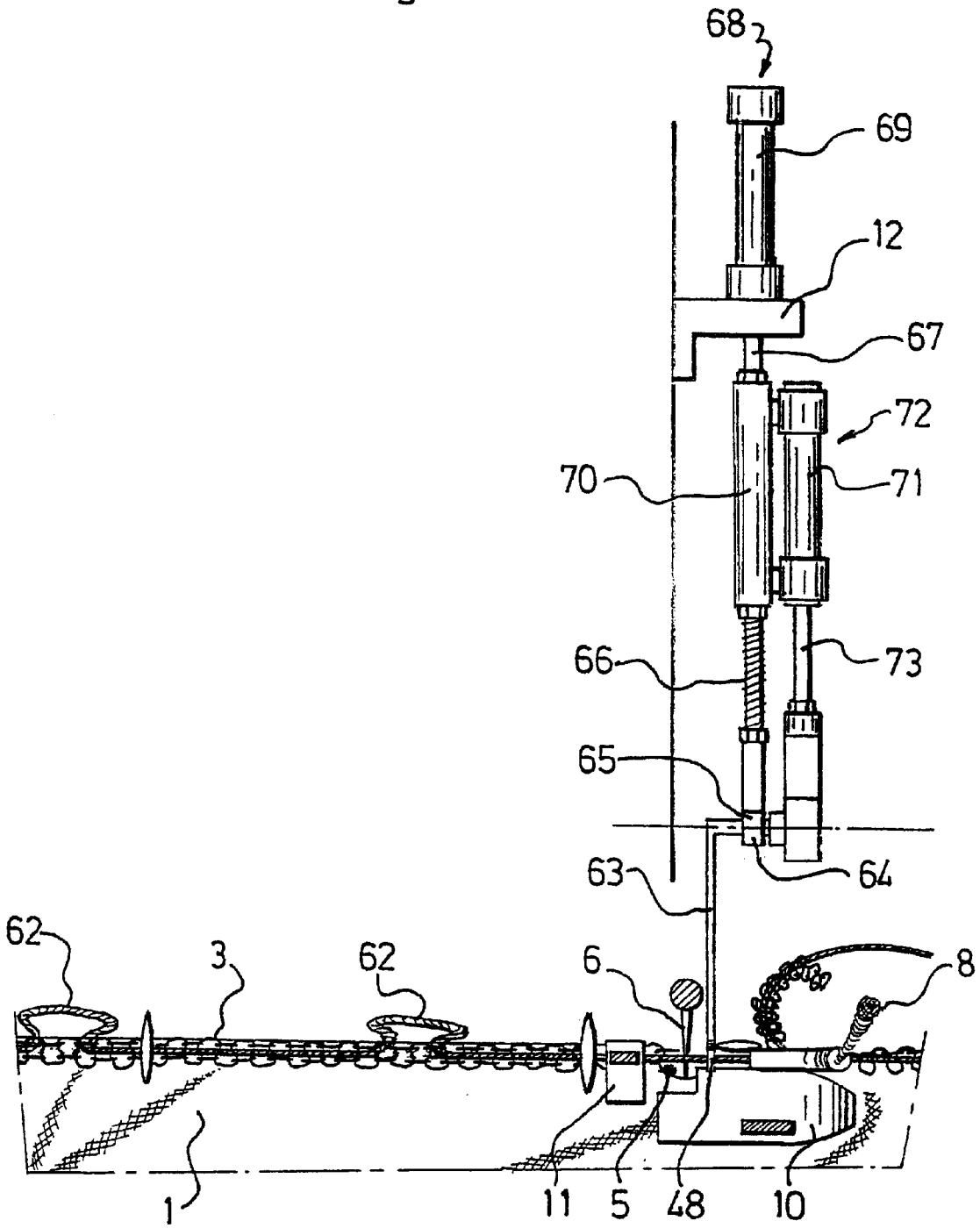
Figure 21A:
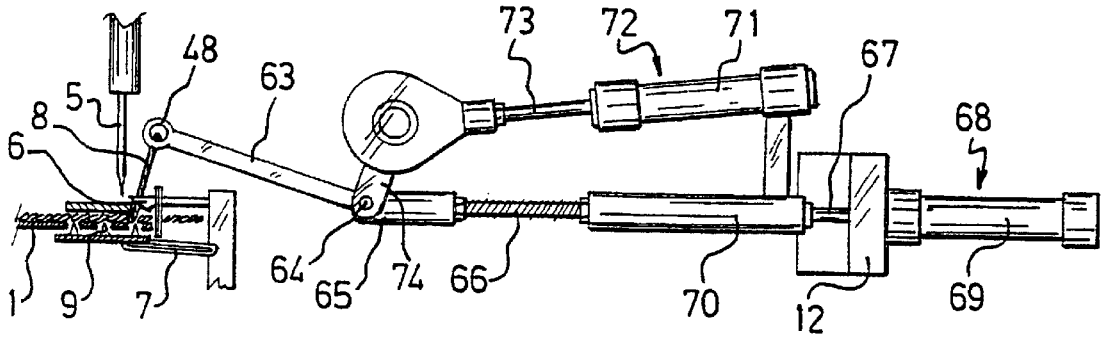
FIGS. 21*a*, 21*b* and 21*c* are partial schematic views in transverse vertical cross-section, illustrating the means for release of the tension thread, respectively in the vertical release position, in the normal sewing position, and in the lateral release position, of the machine according to the invention, in accordance with the variant in FIG. 20.
Figure 21B:
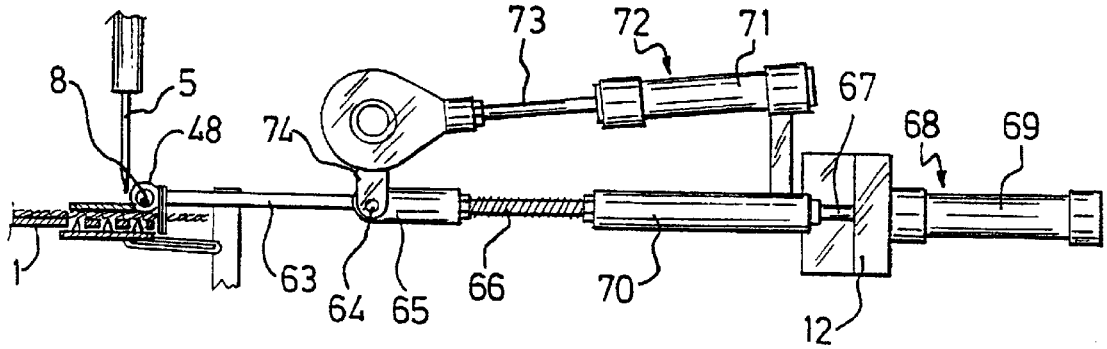
Figure 21C:
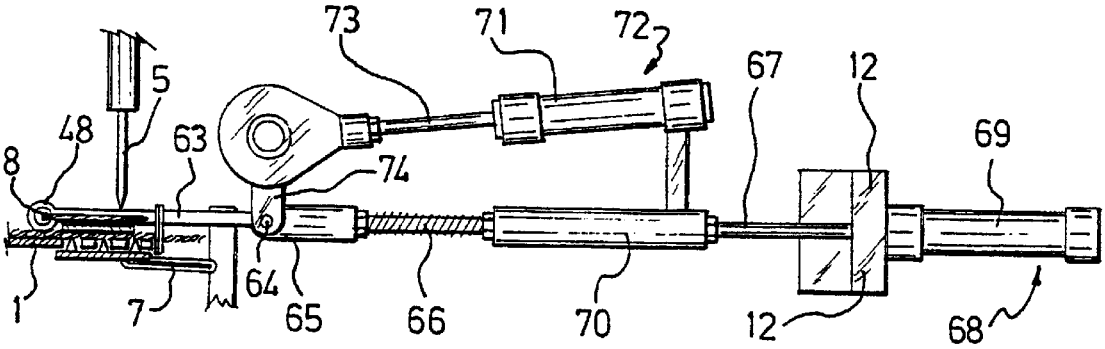
Figure 22:
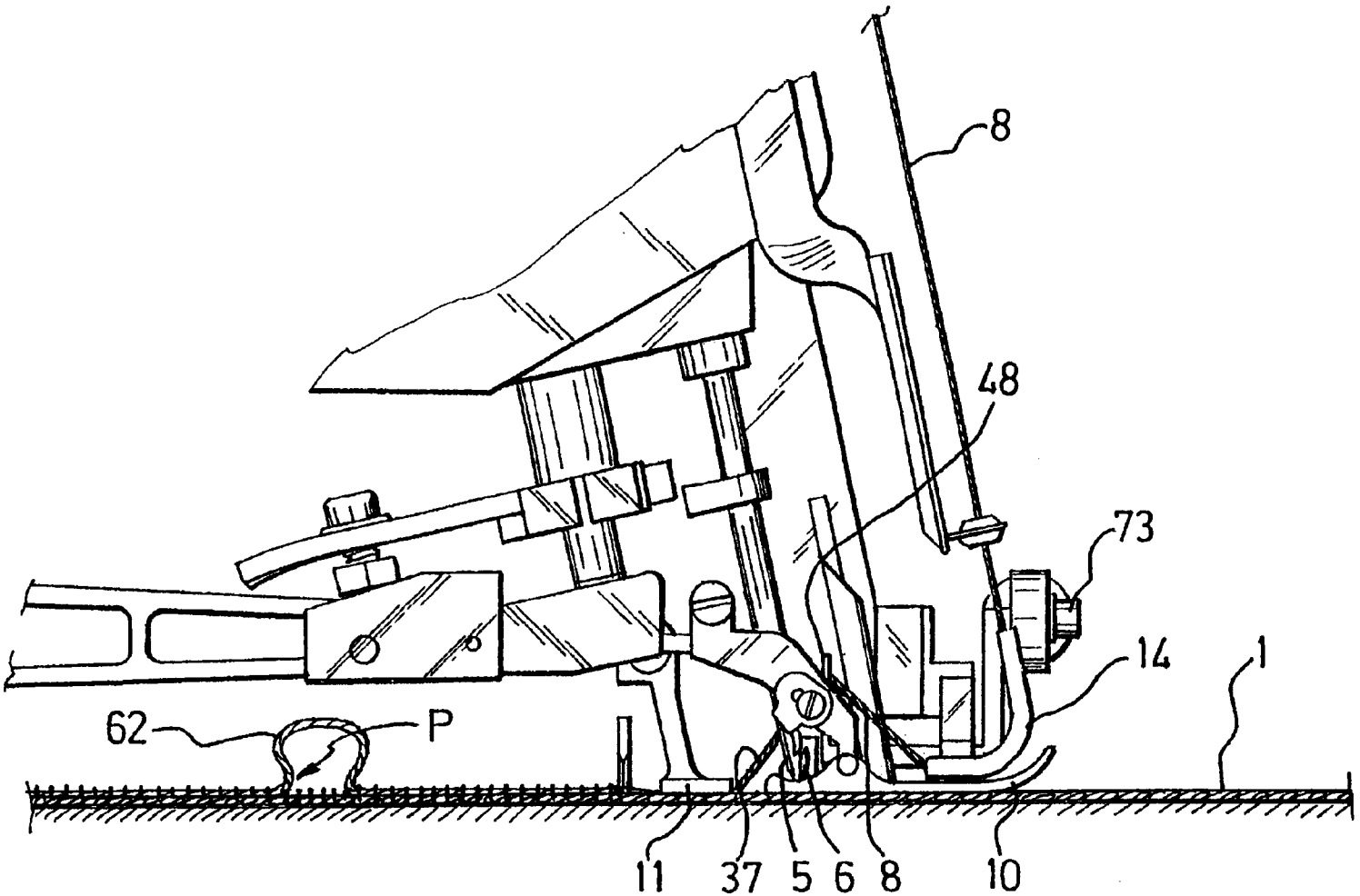
FIG. 22 is a partial schematic lateral view illustrating the means for picking up and means for release, in a vertical release position, of a machine according to the invention, in accordance with the variant in FIGS. 20, 21*a*, 21*b* and 21*c*.

The variant in FIGS. 20 to 22 has the additional advantage that it is possible to prevent with certainty this picking up (passing through) of the tension thread 8 by the needle 5, without requiring synchronisation. In addition, according to this variant, it is possible to pre-orient the loops released from the passage P, more or less vertically relative to the piece 1 to be sewn.

In this variant, as in the variant in FIG. 18, an eyelet 48 for guiding the tension thread 8 is passed through by the tension thread 8, and is disposed downstream from the downstream output of the guiding part 14, which is supported by the upstream presser unit 10, and upstream from the means 5, 6, 7 for picking up.

This eyelet 48 is provided at the free end of an articulated rod 63, which is articulated such as to pivot freely around a horizontal axis 64, which is parallel to the longitudinal direction D of sewing, at the end 65 of a screw/nut system 66 which is supported by the actuation rod 67 of a first double-action horizontal jack 68, the body 69 of which is secured to the frame 12. The screw/nut system 66 permits regulation of the length between the end 65 which supports the axis 64 of articulation of the rod 63, and a support arm 70 which is supported by the actuation rod 67. The support arm 70 supports the body 71 of a second double-action jack 72, the actuation rod 73 of which is articulated on a rocker arm 74, which is integral in rotation around the axis 64 of the rod 63 which supports the eyelet 48. The second jack 72 is thus supported by the actuation rod 67 of the first jack 68. The rocker arm 74 extends upwards, forming an angle of approximately 90° relative to the rod 63 which supports the guiding eyelet 48.

In the normal sewing position (FIG. 21*b*), the actuation rod 67 of the first jack 68 is retracted, and the actuation rod 73 of the second jack 72 is extended. The rod 63 extends at least substantially horizontally, and the guiding eyelet 48 and the tension thread 8 are in the normal sewing position.

When the second jack 72 is actuated from this normal position, its actuation rod 73 retracts, which makes the rod 63 pivot upwards around the axis 64. The eyelet 48 is then displaced upwards (FIG. 21*a*). The extent of this displacement is sufficient for the portion 37 of the tension thread 8 which extends between the downstream movement unit 11 and the eyelet 48, to pass entirely above the area of action of the means 5, 6, 7 for picking up, and in particular above the upper hook 6 (FIG. 22). Thus, the tension thread 8 is no longer sewn into the oversewing stitch 3, and is released vertically upwards. Subsequently, the second jack 72 is actuated in order to extend its actuation rod 73, which re-positions the eyelet 48 in the normal sewing position, and the tension thread 8 is re-inserted in the passage P. This therefore forms a loop 62 of tension thread 8 which is released from the passage P and does not pass beneath the needle 5, in order to form the loops 62. There is thus no risk of picking up the tension thread 8 and locking it, irrespective of the moment when the first jack 68 is actuated. The loops 62 thus formed extend at least substantially vertically upwards from the piece 1, and are therefore pre-oriented. This variant is more particularly applicable to the case of an elastic tension thread 8. The loops 62, which are regularly distributed along the edge of the piece 1, make it possible to upholster and cover with this piece 1 an object which is provided with hooks or hooking studs, the piece 1 being stretched by means of the tension thread 8.

As can be seen in FIG. 21*c*, it is thus possible to form loops or end strands of the tension thread 8, by releasing the tension thread 8 laterally, as in the variant in FIG. 18, by actuating the first jack 68 in order to extend its actuation rod 67, from the normal sewing position.

According to another possible variant of the invention (not shown), the guiding part for the tension thread 8 can be disposed between the support 49 of the upstream presser foot 10 and the motor frame 12, or immediately upstream from the upstream presser foot 10. It is possible to programme movement of displacement upwards of the upstream presser foot 10 simultaneously with lateral displacement of the guiding part, which then passes beneath this upstream presser foot 10. According to the latter variant, it is however necessary to provide a first actuation unit for displacements of the guiding part, and a second actuation unit which can be controlled by the numerical system 44, in order to raise the upstream presser foot 10 once more.

Nevertheless, it should be noted that in all the variants of the invention, the machine according to the invention can easily be obtained by simple modification and addition to a conventional shaving oversewing sewing machine, such as that described and represented in EP-0 223 312 and/or U.S. Pat. No. 4,732,097. In fact, it is sufficient to modify the support device of the upstream presser foot 10, to add to it the downstream movement unit 11 with its associated movement means, and to connect the device to the means for movement of the lower drive lugs 9.

In addition, the invention can form the basis of other variant embodiments. In particular, the invention is applicable to stitches other than oversewing, and thus to machines other than oversewing machines, provided that the stitch forms a passage in which a tension thread can be inserted.

What is claimed is:

1. A method for sewing, on a piece (1) to be sewn and according to a direction of sewing, a stitch (3) consisting of threads, known as auxiliary threads (4), by means (5, 6, 7) for picking up, of a sewing machine, this stitch (3) forming a passage (P), which extends in the direction of sewing (D), with a thread, which is known as the tension thread (8), which is guided and put into position in this passage (P) simultaneously with picking up of the auxiliary threads (4), to be able to slide longitudinally and/or laterally in this passage (P), wherein there is displaced transversely relative to the means (5, 6, 7) for picking up, at least one portion (37) of the tension thread (8), which extends from upstream and immediately to downstream from the means (5, 6, 7) for picking up, between a normal position for putting the tension thread (8) into position in the passage (P), and a position for release of the portion (37) of the tension thread (8), in which the latter is inclined relative to the direction of sewing (D) of the stitch, and passes opposite the means (5, 6, 7) for picking up, beyond the area of action of the means (5, 6, 7) for picking up, and beyond the passage (P), in order to permit cutting off independently of the auxiliary threads (4) of the stitch (3) and/or of the tension thread (8), by at least one cutting blade (16, 17) which is disposed downstream from the means (5, 6, 7) for picking up, and/or formation of loops (62) of the tension thread (8), which are released from the passage (P), whilst sewing is taking place.

2. A method as claimed in claim 1, wherein at least the portion (37) of the tension thread (8) is displaced transversely during sewing of the stitch (3), by means (5, 6, 7) for picking up.

3. A method as claimed in claim 1, wherein, in order to transfer from the normal position to the position of release, the portion (37) of the tension thread (8) is displaced laterally to the side of a work-holder plate (13), and opposite a motor frame (12) of the sewing machine.

4. A method as claimed in claim 1, wherein, in order to transfer from the normal position to the released position, the portion (37) of the tension thread is displaced vertically by being moved away upwards from the piece (1) to be sewn, beyond the area of action of the means (5, 6, 7) for picking up.

5. A method as claimed in claim 1, wherein, in order to displace the portion (37) of the tension thread transversely, there is displaced transversely at least one guiding part (14, 48) for the tension thread (8), which is disposed upstream from the means (5, 6, 7) for picking up.

6. A method as claimed in claim 5, wherein there is displaced transversely at least one guiding part (48, 61), which is distinct from a presser unit.

7. A method as claimed in claim 1, wherein there is displaced transversely an upstream presser unit (10) of the machine, which supports means (14) for guiding the tension thread (8), and the part (1) is moved by a downstream movement unit (11), which is disposed immediately downstream from the means (5, 6, 7) for picking up.

8. A method as claimed in claim 7, wherein the upstream presser unit (10) is displaced laterally such as to release the portion (37) laterally beyond the area of action of the means (5, 6, 7) for picking up, and beyond the passage (P), and the upstream presser unit (10) is also displaced vertically and upwards, in order, in the release position, to prevent any contact of this upstream presser unit (10) with the part (1) to be sewn.

9. A method as claimed in claim 1, in order to allow a strand of tension thread, known as the extension strand (18, 38), to extend beyond an initial end, and beyond a final end of the seam formed by the stitch (3), wherein, on completion of the sewing:

- the portion (37) of the tension thread (8) is displaced laterally by a distance which is sufficient to release the tension thread (8) and move it away laterally from a first blade (16) for cutting of the auxiliary threads (4), which is disposed downstream from the means for picking up (5,6,7);
- sewing of the stitch (3) continues for a length such that the tension thread (8) is released laterally relative to the first cutting blade (16) downstream;
- the first cutting blade (16) is actuated in order to cut the auxiliary threads (4) of the stitching (3), and sewing is interrupted by the means for picking up (5,6,7);
- the piece (1) is displaced in the downstream direction, for a length which corresponds to the sum (d1+d2) of the lengths of the extending strands (18,38) of the tension thread (8), to be formed at the start and at the end of sewing;
- the part of the tension thread (8) to be cut is engaged, in order to separate the extending strand (38) at the end of the piece to be sewn, and the extending strand (18) at the start of a subsequent piece to be sewn, by means of a second cutting blade (17);
- the second cutting blade (17) is actuated; and
- there is replacement to a normal position of the means for picking up (5,6,7), the means (14) for guiding the tension thread, and the said portion (37) of the tension thread, for receipt and sewing of a subsequent piece to be sewn.

10. A method as claimed in claim 9, wherein the said port ion (37) of the tension thread (8) is replaced in a normal position before the second cutting blade (17) is actuated.

11. A sewing machine for implementation of a method according to claim 1, comprising means (5, 6, 7) for picking up at least one stitch (3) formed from auxiliary threads (4) on a piece (1) to be sewn according to a direction of sewing (D), this stitch (3) forming a passage (P) which extends in the direction of sewing (D), and means (14, 48, 61) for guiding a thread, known as the tension thread (8), for putting the latter into position in the passage (P) simultaneously with picking up of the auxiliary threads (4), such that this tension thread (8) can slide longitudinally and/or laterally in this passage (P), wherein it comprises means, known as means for release of the tension thread (8), in order to displace transversely relative to the means (5, 6, 7) for picking up, at least one portion (37) of the tension thread, which extends upstream and immediately downstream from the means (5, 6, 7) for picking up, between a normal position for putting into position of the tension thread (8) in the passage (P), and a position for release of the portion (37) of the tension thread (8), in which the latter is inclined relative to the direction of sewing (D) of the stitch, and passes opposite the means (5, 6, 7) for picking up, beyond the area of action of the means (5, 6, 7) for picking up and beyond the passage (P), in order to permit cutting independently of the auxiliary threads (4) of the stitch (3) and/or of the tension thread (8), by at least the cutting blade (16, 17), which is disposed downstream from the means (5, 6, 7) for picking up and/or formation of loops (62) of the tension thread (8), which are released from the passage (P) whilst sewing is taking place.

12. A machine as claimed in claim 11, wherein the means for release of the tension thread (8) are designed to be able to displace transversely at least the portion (37) of the tension thread (8), during stitching of the stitch (3) by the means (5, 6, 7) for picking up.

13. A machine as claimed in claim 11, comprising a motor frame (12) and a work-holder plate (13), which extend globally on one side of the motor frame (12), from means (5, 6, 7) for picking up, wherein the means for release of the tension thread (8) are designed to displace the portion (37) of the tension thread laterally on the side of the work-holder plate (13), and opposite the motor frame (12), beyond the said passage (P), from the normal position to the position of release.

14. A machine as claimed in claim 11, wherein the means for release are designed to displace the portion (37) of the tension thread vertically, by moving it upwards away from the piece (1) to be sewn, beyond the area of action of the means (5, 6, 7) for picking up.

15. A machine as claimed in claim 11, wherein the means (5, 6, 7) for picking up comprise at least one needle (5), and contain means (9, 10, 11) for movement of the piece to be sewn, wherein the means (9, 10, 11) for movement comprise at least one unit, known as the downstream movement unit (11), which is disposed immediately downstream from the needle (5), and the means for release of the tension thread (8) are designed to displace transversely at least one portion (37) of the tension thread, which extends in the upstream direction, from the downstream movement unit (11).

16. A machine as claimed in claim 1, wherein the means (14, 48, 61) for guiding the tension thread comprise at least one upstream guiding part (14, 48, 61), which is disposed upstream from the means (5, 6, 7) for picking up, and is supported by support means which are designed to be able to position this guiding part (14, 48, 61) in a normal position in which it guides the tension thread (8), relative to the stitch (3), or in a position for release of the tension thread (8), in which it is displaced transversely relative to the means (5, 6, 7) for picking up, such that these means for support of the upstream guiding part(s) (14, 48, 61) act as means for release of the tension thread (8).

17. A machine as claimed in claim 16, wherein the means for release comprise means (45, 68, 72) which are designed to be able to displace transversely at least one guiding part (48, 61) which is distinct from a presser unit.

18. A machine as claimed in claim 16, wherein the means for release of the tension thread comprise at least one double-action actuation unit (23, 45, 68, 72), making it possible to displace the said guiding part (14, 48, 61) transversely between the normal position and the position for release of the tension thread, and vice versa.

19. A machine as claimed in claim 11, comprising means (14) for guiding the tension thread, formed and/or supported by an upstream presser unit (10) for movement of the piece (1) to be sewn, and means (22, 23, 24) to support the upstream presser unit (10) relative to a frame (12) of the machine, which, in an active position, are designed to apply the upstream presser unit (10) in contact with the piece (1) to be sewn, wherein the means (22, 23, 24) for support are designed to be able to place the upstream presser unit (10) in the position of release of the tension thread (8), in which the upstream presser unit (10) and the means (14) for guiding the tension thread are displaced laterally relative to the means (5, 6, 7) for picking up, such that these means (22, 23, 24) for support of the upstream presser unit (10) act as means for release of the tension thread (8).

20. A machine as claimed in claim 19, wherein the means (22, 23, 24) for support comprise:

an arm (22) which is articulated by a downstream end, on the frame (12) of the machine, such that it can pivot around a vertical axis (27) and around a transverse horizontal axis (28), and supports the upstream presser unit (10) with the means (14) for guiding the tension thread at its upstream end;

a double-action actuation unit (23), which is supported by the frame (12), and has an actuation rod (25) which is mobile in translation;

a rocker arm (24) for connection between the arm (22) and the actuation rod (25);

and the actuation unit (23) is mounted on the frame (12), such that in a normal position, the actuation rod (25) can exert support pressure on the arm (22) in the direction of application of the upstream presser unit (10), on the piece (1) to be sewn.

21. A machine as claimed in claim 20, wherein the rocker arm (24) for connection has torsion to give rise to movements of lateral displacement of the upstream presser unit (10), by pivoting the arm (22) around the vertical axis (27), and of vertical displacement of the upstream pressure unit (10), by pivoting the arm (22) around the transverse horizontal axis (28).

22. A machine as claimed in claim 11, wherein it comprises a first blade (16) for cutting auxiliary threads (4), which is disposed downstream from the means (5, 6, 7) for picking up, and the means (22, 23, 24) for release of the tension thread (8) are designed to displace the portion (37) of the tension thread laterally, from the normal position, by a distance which is sufficient to clear the tension thread (8) laterally from the first blade (16) for cutting the auxiliary threads (4).

23. A machine as claimed in claim 22, wherein it comprises two blades (16, 17) for cutting threads, the first blade (16) being disposed downstream from the means (5, 6, 7) for picking up, in order to cut the auxiliary threads (4) of the oversewing, the second blade (17) being disposed downstream from the first (16), at a distance corresponding to the length (d1) of a strand (18) of tension thread, known as the projecting strand, which is allowed to extend beyond an initial end of the seam formed by the stitch (3), on a subsequent piece to be sewn.

24. A machine as claimed in claim 15, wherein the first blade (16) is disposed immediately downstream and in the vicinity of the downstream movement unit (11).

25. A machine as claimed in any claim 11, wherein it comprises means (41 to 44) for automatic guiding of the piece (1) to be sewn, relative to the means (14) for guiding, and, if applicable, relative to the cutting blade(s) (16, 17), and means (44) for automatic control of the means for release of the tension thread, of the cutting blade(s) (16, 17).

26. A machine as claimed in claim 25, wherein the means (41 to 44) for automatic guiding of the piece (1) to be sewn comprise a grasping robot, which is designed and programmed to displace the piece (1) to be sewn on a workplate (13) of the machine, as the sewing is carried out.

27. A machine as claimed in claim 25, wherein the means (41 to 44) for automatic guiding of the piece (1) to be sewn, and the means (44) for automatic control of the means for release of the tension thread, comprise a programmable system (44), which is designed and programmed, as the sewing takes place, to control the means (5, 6, 7) for picking up, displacements of the piece (1) to be sewn, the means for release of the tension thread (8), and the cutting blade(s) (16, 17).

* * * * *